US010480897B2

(12) United States Patent
Keeney et al.

(10) Patent No.: US 10,480,897 B2
(45) Date of Patent: Nov. 19, 2019

(54) HANDGUARD SYSTEM FOR FIREARMS

(71) Applicant: Occam Defense Solutions Inc., Moscow, ID (US)

(72) Inventors: Brian Keeney, Moscow, ID (US); David S. Giessel, Cambridge (CA); Austin Colomaio, Bath, NY (US)

( * ) Notice: Subject to any disclaimer, the term of this patent is extended or adjusted under 35 U.S.C. 154(b) by 0 days.

(21) Appl. No.: 16/205,191

(22) Filed: Nov. 29, 2018

(65) Prior Publication Data

US 2019/0162503 A1 May 30, 2019

Related U.S. Application Data

(60) Provisional application No. 62/592,206, filed on Nov. 29, 2017, provisional application No. 62/617,253, filed on Jan. 14, 2018, provisional application No. 62/664,899, filed on Apr. 30, 2018.

(51) Int. Cl.

| | |
|---|---|
| ***F41C 23/16*** | (2006.01) |
| ***F41G 11/00*** | (2006.01) |
| ***F41C 27/00*** | (2006.01) |

(52) U.S. Cl.
CPC ..... *F41C 23/16* (2013.01); *F41C 27/00* (2013.01); *F41G 11/003* (2013.01)

(58) Field of Classification Search
CPC ..... F41C 23/16; F41A 13/00
See application file for complete search history.

(56) References Cited

U.S. PATENT DOCUMENTS

| | | | | |
|---|---|---|---|---|
| 8,141,285 | B2 * | 3/2012 | Brown | F41A 3/66 42/71.01 |
| 10,018,445 | B2 * | 7/2018 | Fesas | F41A 13/00 |
| 2007/0033851 | A1 * | 2/2007 | Hochstrate | F41A 5/18 42/75.01 |
| 2011/0239513 | A1 * | 10/2011 | Sandman | F41C 23/16 42/90 |
| 2012/0198990 | A1 | 8/2012 | Brittin | |
| 2014/0331538 | A1 | 11/2014 | Spiegelhauer | |
| 2015/0192385 | A1 * | 7/2015 | Krebs | F41C 23/16 42/71.01 |

OTHER PUBLICATIONS

Sureshot Armament Group [online], [dated Nov. 29, 2017], [retrieved on Nov. 29, 2017], Retrieved from the internet <URL: https://www.facebook.com/SureshotArmamentGroup/posts/1496738597061569>.

* cited by examiner

*Primary Examiner* — Stephen Johnson
(74) *Attorney, Agent, or Firm* — Asgaard Patent Services, LLC; F. Wayne Thompson, Jr.

(57) ABSTRACT

Implementations of a handguard system for firearms is provided. The handguard system is configured for use with a rifle (e.g., an AK-type rifle) and to support rail mounted firearm accessories. In some implementations, the handguard system comprises a rear sight block configured to fit about the barrel of a rifle and a handguard that can be removably secured to the rear sight block without making contact with the barrel (i.e. the handguard system is free-floating). In other implementations, the handguard system comprises a rear sight block and a handguard that can be removably secured together and thereby form a clamp that secures the handguard system to the barrel of a rifle. The handguard may be configured so that modular sections of MIL-STD-1913 mounting rail can be attached to various locations on the handguard as needed to provide a mounting structure for MIL-STD-1913 rail mounted firearm accessories.

20 Claims, 46 Drawing Sheets

SECTION A-A

HANDGUARD SYSTEM FOR FIREARMS

CROSS REFERENCE TO RELATED APPLICATION

This application claims the benefit of U.S. Provisional Application Ser. No. 62/592,206, which was filed on Nov. 29, 2017, U.S. Provisional Application Ser. No. 62/617,253, which was filed on Jan. 14, 2018, and U.S. Provisional Application Ser. No. 62/664,899, which was filed on Apr. 30, 2018, the entireties of which are incorporated herein by reference.

TECHNICAL FIELD

This disclosure relates to implementations of a handguard system for firearms.

BACKGROUND

Handguards are designed to protect the shooter from being burned due to contact with the hot barrel of a firearm. Frequently, handguards are configured to facilitate the connection of firearm accessories (e.g., optics, laser, night vision device, foregrips, bipod, etc.) to the firearm. Since contact between the handguard and the barrel can decrease the accuracy of a firearm, handguards configured to keep the firearm barrel free floating may be used to increase accuracy.

In general, a Kalashnikov rifle or AK-type rifle (e.g., AK-47, AKM, AK-74, etc.) uses a handguard and a gas tube cover to protect the shooter from being burned. Typically, a first end of the handguard is supported by the receiver and a second end is supported by a handguard retaining cap positioned about the barrel. As such, the prior art handguard found on most AK-type rifles is non-free floating because the second end of the handguard is supported by the barrel. While free float construction handguards are known, they are not well suited to being adapted for use with, or retrofit to, AK-type rifles.

Accordingly, it can be seen that needs exist for the handguard system disclosed herein. It is to the provision of a handguard system that is configured to address these needs, and others, that the present invention is primarily directed.

SUMMARY OF THE INVENTION

Implementations of a handguard system for firearms is provided. The handguard system is configured for use with a rifle (e.g., an AK-type rifle) and to support rail mounted firearm accessories (e.g., optics, laser, night vision device, foregrips, bipod, etc.).

In some implementations, the handguard system comprises a rear sight block that can be secured to the barrel of a rifle, and a handguard that can be removably secured to the rear sight block without making contact with the barrel (i.e. the handguard is not supported by the barrel of the rifle). The handguard is two pieces, a lower handguard section that can be secured to the rear sight block and an upper handguard section that can be removably secured to the lower handguard section. In some implementations, the handguard may be a single unitary piece. The handguard is configured so that modular sections of MIL-STD-1913 mounting rail (or Pica tinny rail) can be attached to various locations on the handguard as needed to provide a mounting structure for MIL-STD-1913 rail mounted firearm accessories (e.g., optics, laser, night vision device, foregrips, bipod, etc.).

In some implementations, the bottom portion of the rear sight block is configured so that the lower handguard section can be secured thereto. The bottom portion of the rear sight block comprises a first sidewall, a second sidewall, and a bottom sidewall. In some implementations, the first sidewall and the second sidewall of the rear sight block may include a first guide groove and a second guide groove, respectively, therein.

The lower handguard section includes a first end portion that can be secured to the bottom portion of the rear sight block, and an opposed second end portion located at the barrel end of the rifle. The first end portion of the lower handguard section is configured to clamp onto the bottom portion of the rear sight block when secured thereto by suitable fasteners (e.g., threaded fasteners). In some implementations, the first end portion of the lower handguard section includes a first boss and a second boss that are configured to be received within the first guide groove and the second guide groove, respectively, of the rear sight block. In this way, the handguard may be prevented from rotating and/or shifting when secured to the rear sight block.

In some implementations, the handguard system may further comprise a heat shield that is positioned within the interior of the lower handguard section, and a front cap that is secured to the distal end of the handguard.

In some implementations, the front cap is configured to minimize deflection of the handguard. The deflection of the handguard is limited by the opening in the front cap; the range of deflection allowed by the front cap being a function of the interior diameter of the opening and the exterior diameter of the firearm barrel.

In another implementation, the handguard system comprises a rear sight block that includes a first boss and a second boss on the first sidewall and the second sidewall, respectively, of the bottom portion. The handguard comprises a handguard chassis that can be removably secured to the rear sight block, a heat shield positioned within the handguard chassis that is configured to act as a thermal break, and a protective outer cover for the exterior of the handguard chassis. The first end portion of the handguard chassis includes a first guide groove and a second guide groove that are configured to receive the first boss and the second boss, respectively, of the rear sight block. In this way, the handguard may be prevented from rotating and/or shifting when secured to the rear sight block.

In yet another implementation, the handguard system comprises a rear sight block and a handguard that can be removably secured together and thereby form a clamp that secures the handguard system to the barrel of a rifle. The handguard is two pieces, a lower handguard section that can be secured to the rear sight block and an upper handguard section that can be removably secured to the lower handguard section. In some implementations, the handguard may be a single unitary piece. The rear sight block and the lower handguard section include clamp jaws configured to cooperatively engage with the outer surface of a firearm barrel, thereby forming the clamp that secures the handguard system to the barrel of rifle. The fasteners (e.g., threaded fasteners) used to secure the lower handguard section to the rear sight block also draw the clamp surfaces together.

In some implementations, the upper handguard section and the rear sight block are a single unitary piece. Once the rear sight block and the lower handguard section are clamped onto the barrel, the upper handguard section can then be secured to the lower handguard section.

In some implementations, the handguard system may further comprise a gas tube yoke that is configured to support and position the gas tube of a rifle between the gas block on the barrel and the guide bore of the rear sight block. In some implementations, the gas tube yoke comprises a first clamp positioned adjacent a second clamp, and a fastener. The first clamp and the second clamp are configured to fit about a portion of the gas tube and the barrel, respectively. The gas tube yoke is configured so that tightening the fastener causes the clamp jaws of each clamp to be drawn together. In this way, the first clamp and the second clamp may be affixed to the gas tube and the barrel, respectively.

BRIEF DESCRIPTION OF THE DRAWINGS

Like reference numerals refer to corresponding parts throughout the several views of the drawings.

DETAILED DESCRIPTION

FIGS. 1-4 illustrate an AK-type firearm 105 equipped with an example handguard system 100 manufactured in accordance with the principles of the present disclosure. In some implementations, the handguard system 100 is configured to keep the firearm barrel 110 free floating. In this way, forces applied to the handguard system 100 via the shooter's hand, a sling, or a bipod are not transmitted to the firearm barrel 110. In general, free floating the firearm barrel allows for more accurate shooting. In some implementations, the handguard system 100 may be configured to support rail mounted firearm accessories (e.g., an optic, light, laser, night vision device, foregrip, bipod, etc.).

Figure 5A:
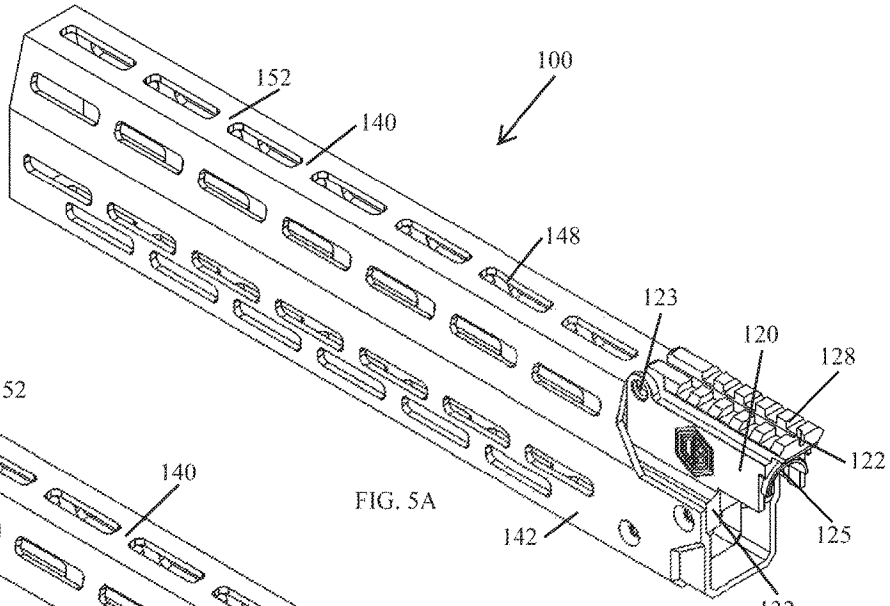
FIG. 5A illustrates a side perspective view of the handguard system shown in FIG. 1, wherein the handguard system is not mounted on an AK-type rifle.
Figure 5B:
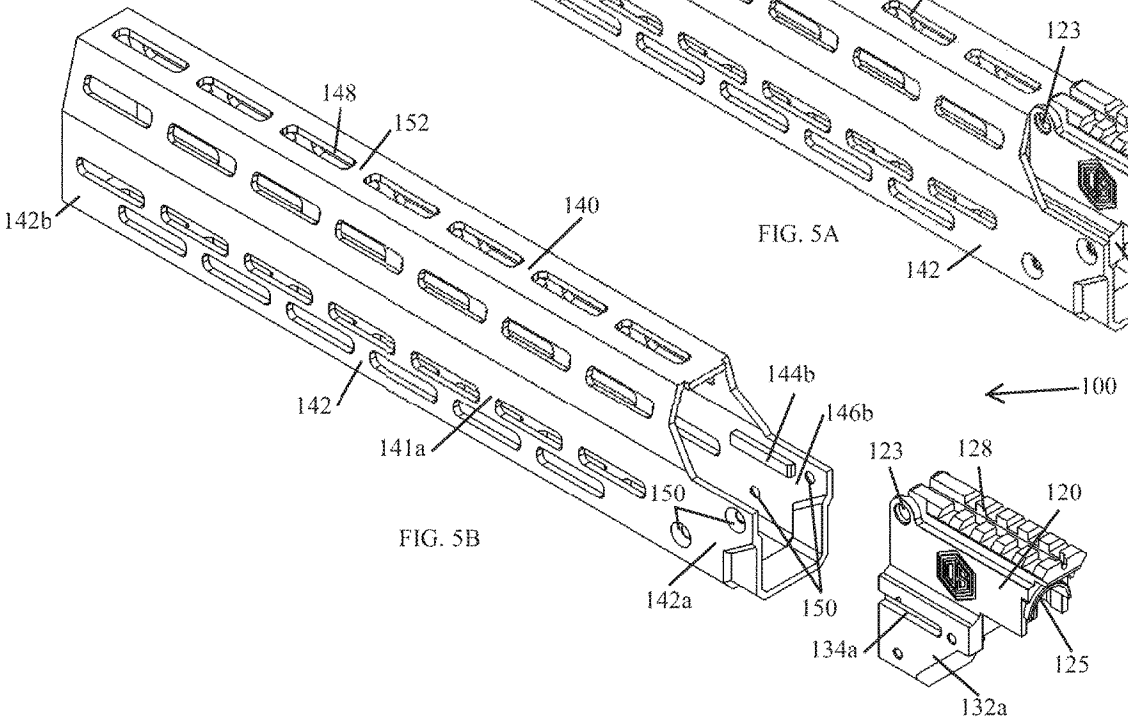
FIG. 5B illustrates a side perspective view of the handguard system shown in FIG. 5A, wherein the handguard is detached from the rear sight block.
Figure 6:
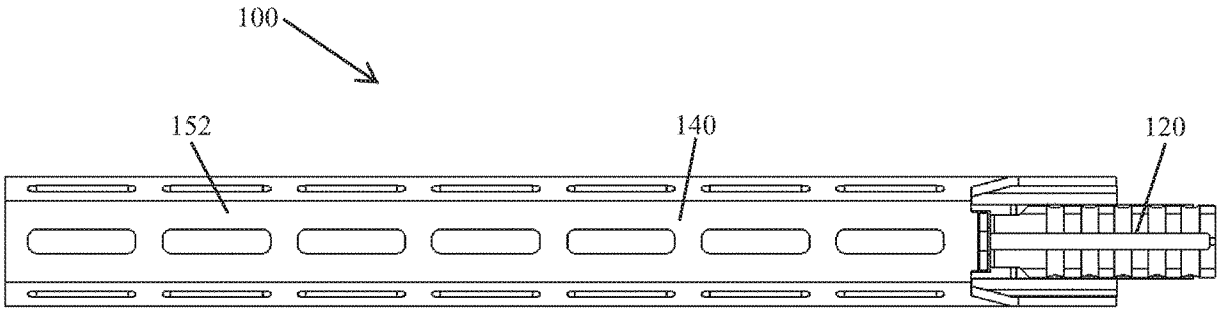
FIG. 6 illustrates a top view of the handguard system shown in FIG. 5A.

As shown in FIGS. 5A and 5B, in some implementations, the handguard system 100 may comprise a rear sight block 120 and a handguard 140. In some implementations, the handguard 140 may be removably secured to the rear sight block 120 without making contact with the firearm barrel 110. In this way, the handguard system 100 may be configured to keep the firearm barrel free floating.

FIGS. 5A-5B, 6, 7A-7B, and 8A-8C illustrate an example implementation of the rear sight block 120 of the handguard system 100. In some implementations, the rear sight block 120 may include several features associated with prior art rear sight blocks found on AK-type rifles. For example, the rear sight block 120 may include a gas tube locking lever bore 123, a guide bore 124 for the piston 107 (see, e.g., FIG. 3B), a curved slot 125 on the backend thereof, or a combination thereof.

Figure 2:
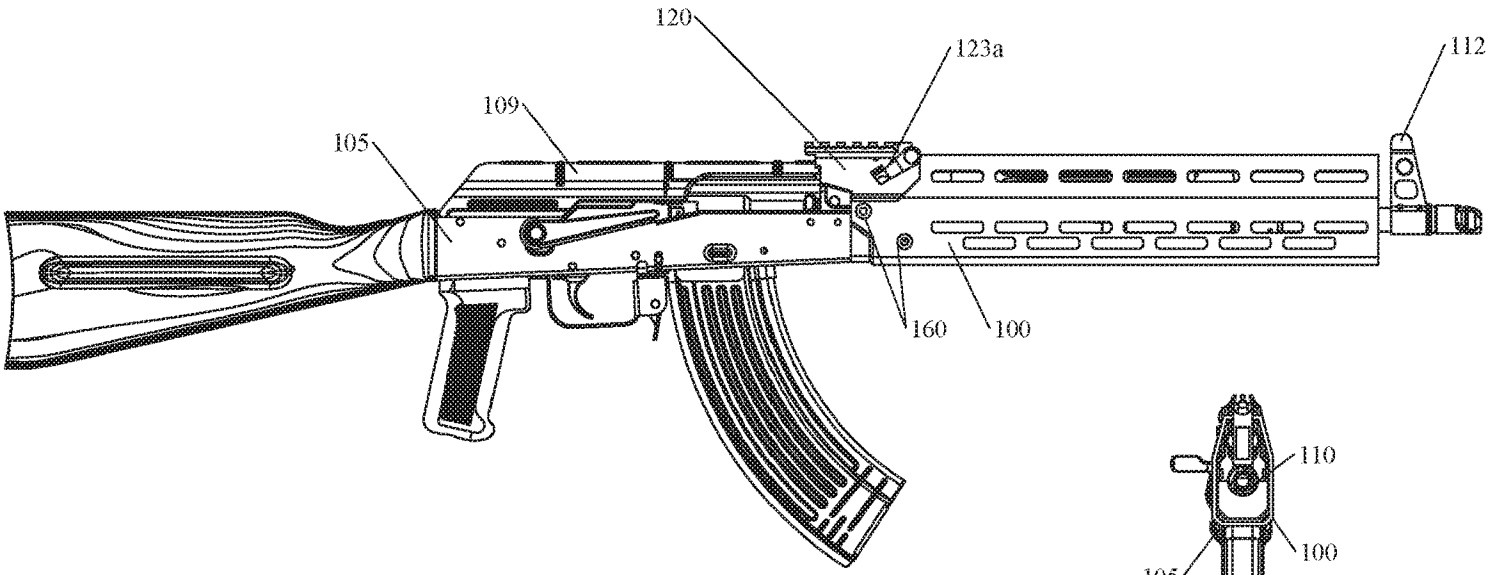
FIG. 2 illustrates a right side view of the example handguard system shown in FIG. 1.
Figure 4:
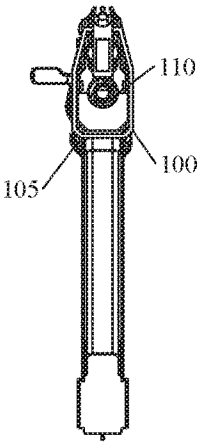
FIG. 4 illustrates a front end view of the handguard system shown in FIG. 1.
Figure 8C:
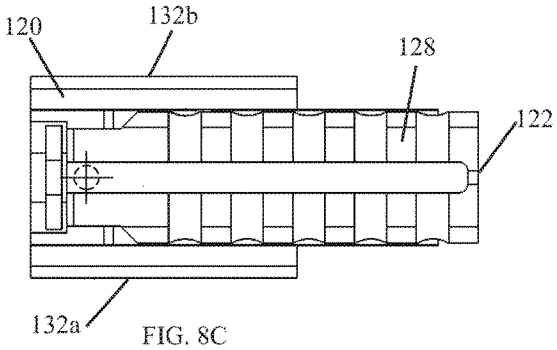
FIG. 8C illustrates a top view of the rear sight block shown in FIG. 8A.
Figure 8A:
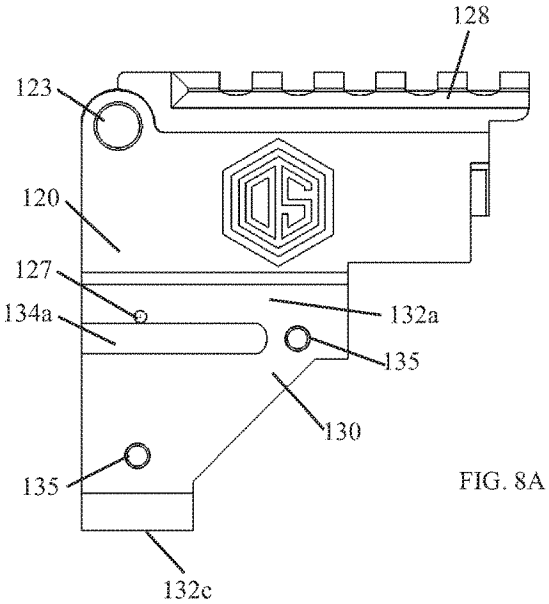
FIG. 8A illustrates a left side view of the rear sight block shown in FIG. 5B.

As shown in FIGS. 2 and 8A, in some implementations, the gas tube locking lever bore 123 may be in the same location as the gas tube locking lever bore found on prior art rear sight blocks used with AK-type rifles. In this way, a gas tube locking lever 123*a*, well known to those of ordinary skill in the art, may be used to secure the gas tube in place on an AK-type rifle 105.

As shown in FIGS. 2 and 5A-5B, in some implementations, the curved slot 125 in the backend of the rear sight block 120 may be configured to support the front end of the dust cover 109 for an AK-type rifle 105. In some implementations, the curved slot 125 may be in the same location on the rear sight block 120 as it would be on prior art rear sight blocks used with AK-type rifles. In this way, the dust cover 109 may be secured to an AK-type rifle in the same or similar manner as found in the prior art.

As shown in FIGS. 5A-5B and 8A-8C, in some implementations, the rear sight block 120 may be configured to provide an optic mounting interface 128 on a top side thereof that includes an integrated nonadjustable (i.e., fixed) rear sight notch 122 therein. In some implementations, the optic mounting interface 120 may be used to secure an optical gun sight thereon (e.g., a reflex sight and/or a telescopic sight). The general features and advantages of the optic mounting interface 128 are described in U.S. Pat. No. 9,696,118, filed on May 5, 2016, entitled "REAR SIGHT BLOCK FOR AK-TYPE RIFLES", and U.S. Pat. No. 9,816,787, filed on May 12, 2017, entitled "REAR SIGHT BLOCK FOR AK-TYPE RIFLES", both of which are owned by the present applicant and are hereby expressly incorporated by reference as if fully set forth herein. In some implementations, the rear sight block 120 may include an adjustable rear sight leaf, well known to those of ordinary skill in the art, in-lieu of an optic mounting interface 128.

Figure 3A:
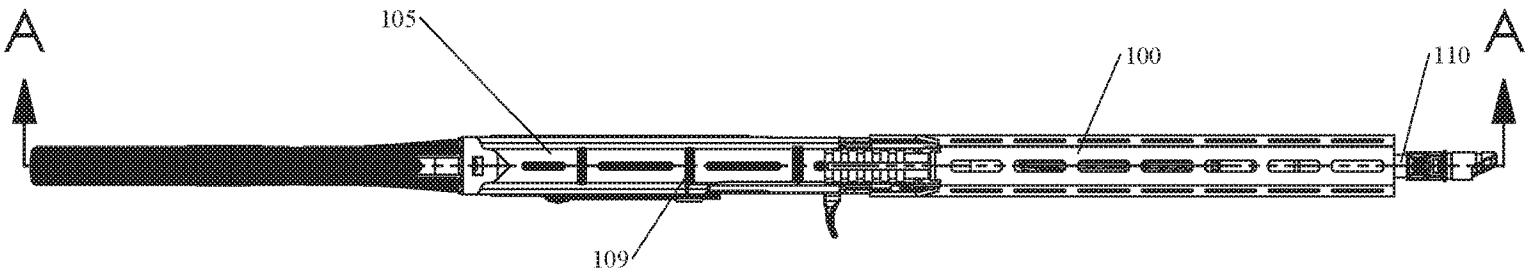
FIG. 3A illustrates a top view of the handguard system shown in FIG. 1.
Figure 3B:
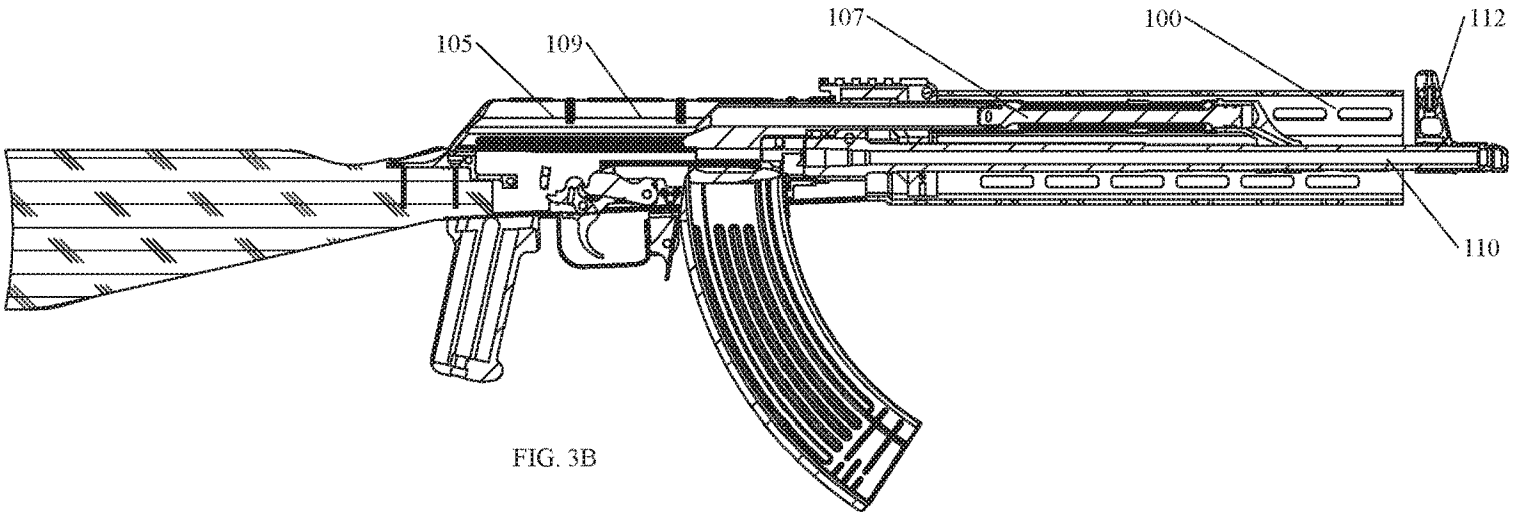
FIG. 3B illustrates a cross-sectional view of the handguard system, and the AK-type rifle on which it is mounted, taken along line A-A of FIG. 3A.
Figure 7A:
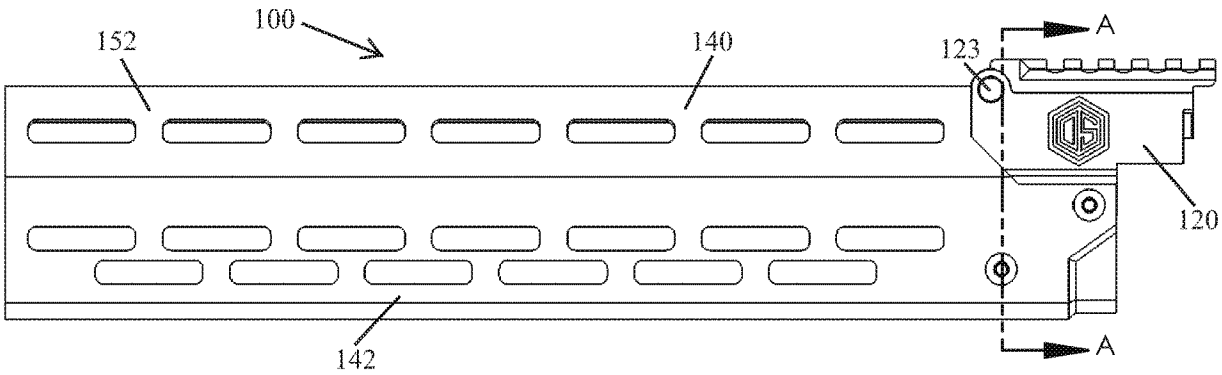
FIG. 7A illustrates a left side view of the handguard system shown in FIG. 5A.
Figure 7B:
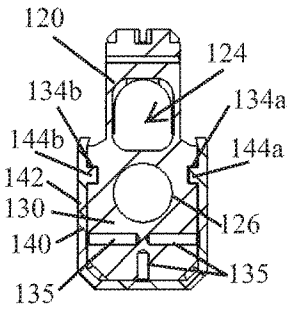
FIG. 7B illustrates a cross-sectional view of the handguard system taken along line A-A of FIG. 7A.
Figure 8B:
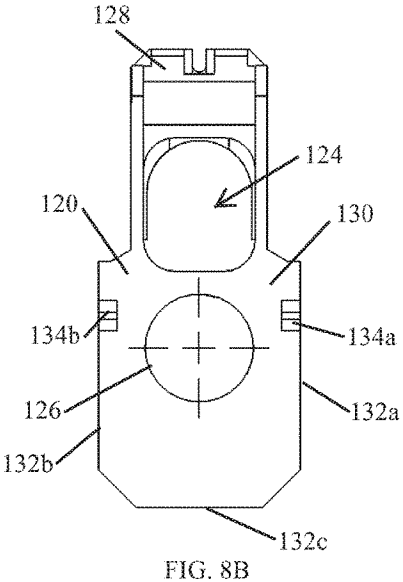
FIG. 8B illustrates a front end view of the rear sight block shown in FIG. 8A.

As shown in FIGS. 3B, 7B, and 8B, in some implementations, the bottom portion 130 of the rear sight block 120 may include a bore 126 therethrough that is configured to receive the barrel 110 of an AK-type rifle therein. In some implementations, the bore 126 extending through the bottom portion 130 of the rear sight block 120 is configured to be press-fit (i.e., an interference fit which is forced together using a hydraulic press) onto the barrel 110 of an AK-type rifle. In some implementations, the bore 126 extending through the bottom portion 130 of the rear sight block 120 is configured to serve the same function as the sleeve found on prior art rear sight blocks used with AK-type rifles. In this way, the rear sight block 120 may be precisely positioned and rigidly secured on the barrel 110 of an AK-type rifle 105. In some implementations, the rear sight block 120 may also include an opening 127 therethrough into which a dowel pin is press-fit to further secure the rear sight block 120 to the barrel 110 (see, e.g., FIG. 8A). This is a well-known prior art method of installing a rear sight block onto the barrel of an AK-type rifle.

Figure 1:
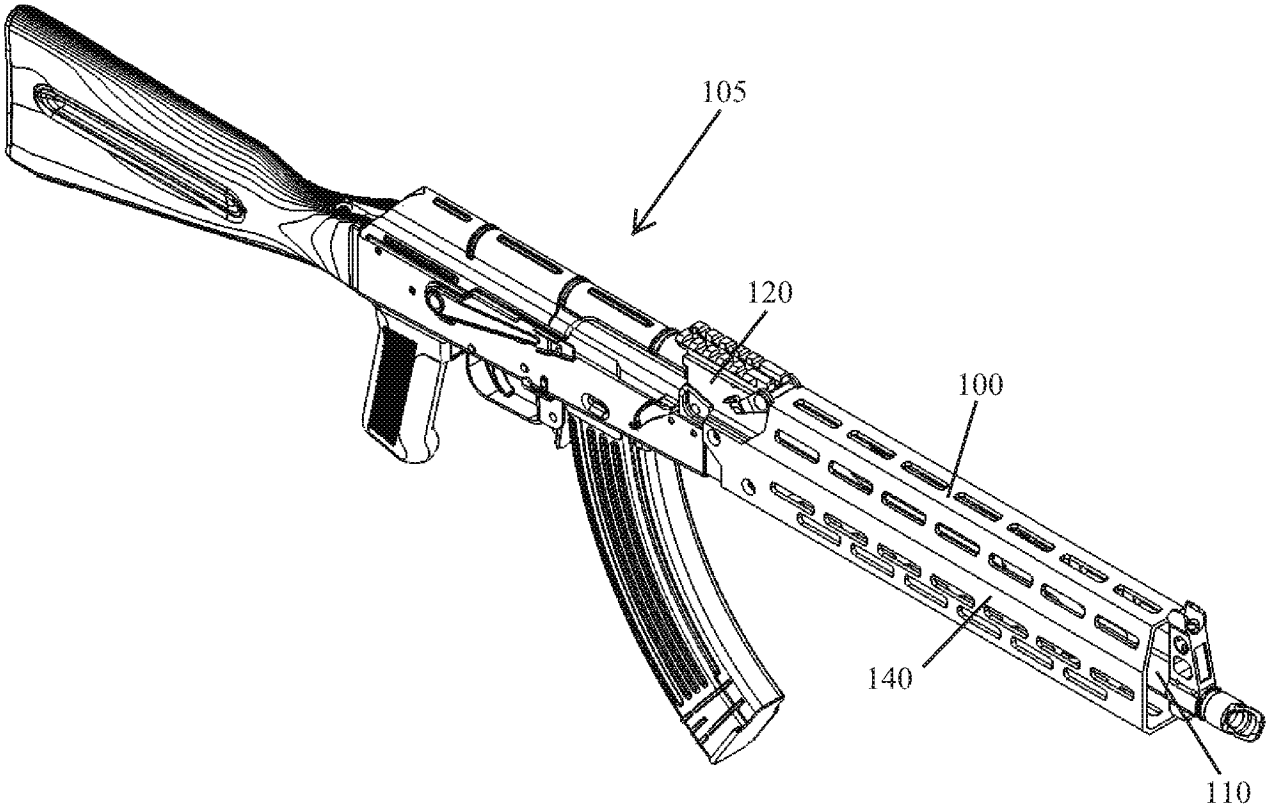
FIG. 1 illustrates a side perspective view of an example handguard system manufactured in accordance with the principles of the present disclosure, wherein the handguard system is mounted on an AK-type rifle.

As shown in FIGS. 1 and 2, in some implementations, the rear sight block 120 may be positioned on the barrel 110 of an AK-type rifle 105 so that the rear sight notch 122 is aligned with the front sight post found in the front sight tower 112. The precise alignment of the rear sight notch 122 with the front sight post ensures that the front sight post can be adjusted sufficiently to make the point of aim provided by the iron sights (the combination of the rear sight notch 122 and the front sight post) coincide with the point of impact of a projectile fired from the rifled barrel.

As shown in FIGS. 5A-5B, 7A-7B, and 8A-8C, in some implementations, the bottom portion 130 of the rear sight block 120 may be configured so that the lower handguard section 142 can be secured thereto. In some implementations, the bottom portion 130 of the rear sight block 120 may comprise a first sidewall 132*a*, a second sidewall 132*b*, and a bottom sidewall 132*c*.

As shown in FIG. 8B, in some implementations, the first sidewall 132*a* and the second sidewall 132*b* of the rear sight block 120 may include a first guide groove 134*a* and a second guide groove 134*b*, respectively, therein. Each guide groove 134*a*, 134*b* is configured to receive therein a boss 144*a*, 144*b* extending from an interior sidewall 146*a*, 146*b* defined by the lower handguard section 142 (see, e.g., FIG. 7B). In this way, the handguard 140 may be prevented from rotating and/or shifting when secured to the rear sight block 120.

As shown in FIGS. 7B and 8A, in some implementations, the sidewalls 132*a*, 132*b*, 132*c* of the rear sight block 120 may each include one or more threaded openings 135 therein. Each opening 135 is configured to receive therein a fastener (e.g., a threaded fastener 160) suitable for securing the lower handguard section 142 to the bottom portion 130 of the rear sight block 120 (see, e.g., FIG. 2).

Figure 9C:
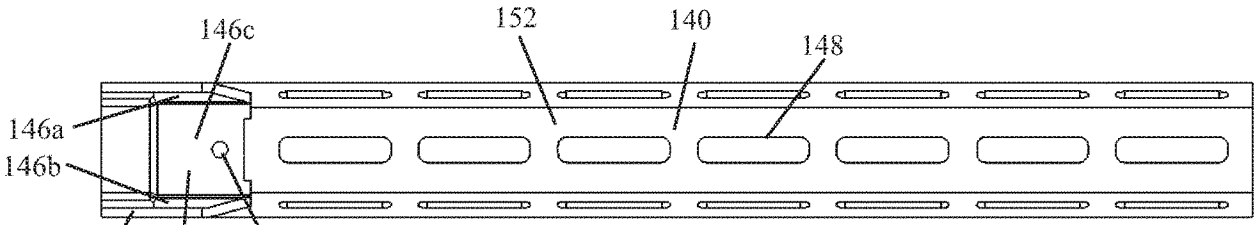
FIG. 9C illustrates a top view of the handguard shown in FIG. 9A.
Figure 9A:
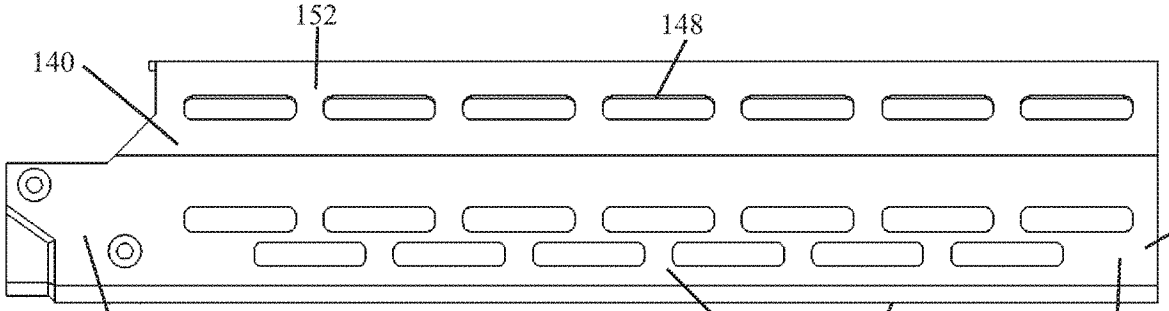
FIG. 9A illustrates a right side view of the handguard shown in FIG. 5B.
Figure 9B:
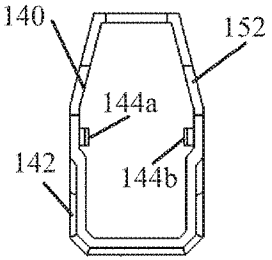
FIG. 9B illustrates a front end view of the handguard shown in FIG. 9A.
Figure 10:
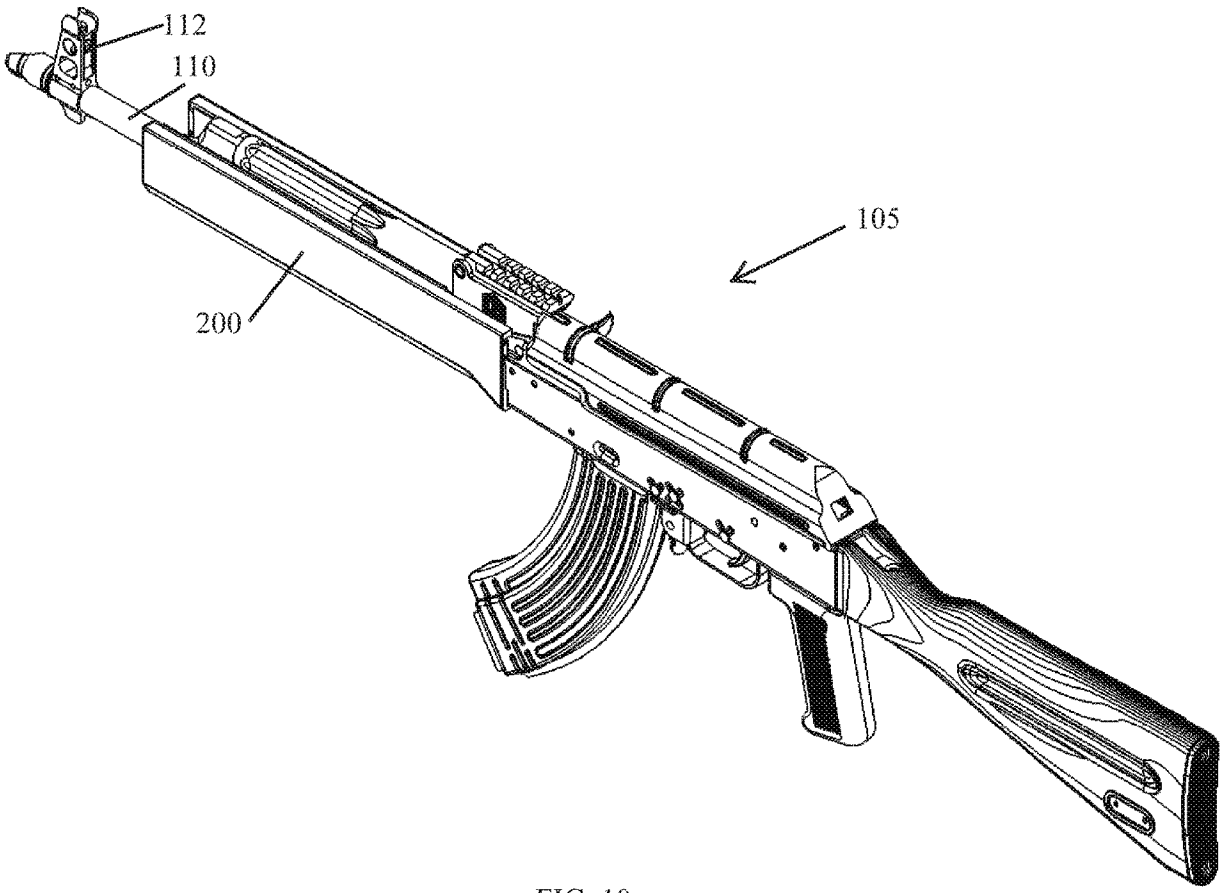
FIG. 10 illustrates a side perspective view of another example handguard system manufactured in accordance with the principles of the present disclosure, wherein the handguard system is mounted on an AK-type rifle.
Figure 11:
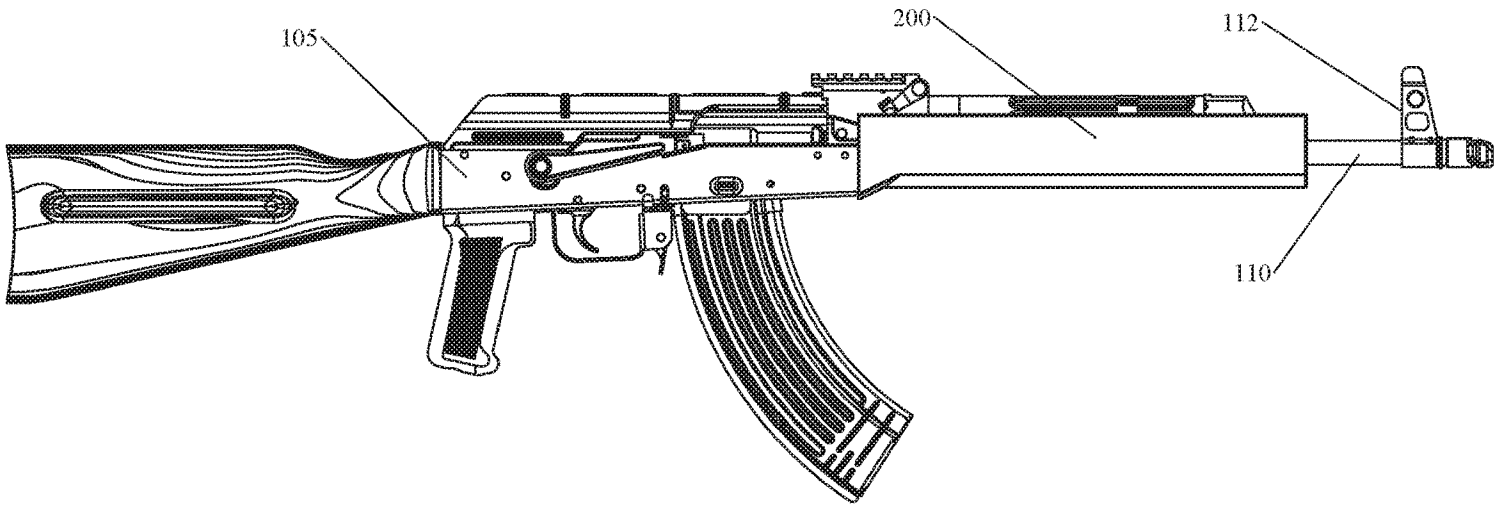
FIG. 11 illustrates a right side view of the example handguard system shown in FIG. 10.
Figure 12A:
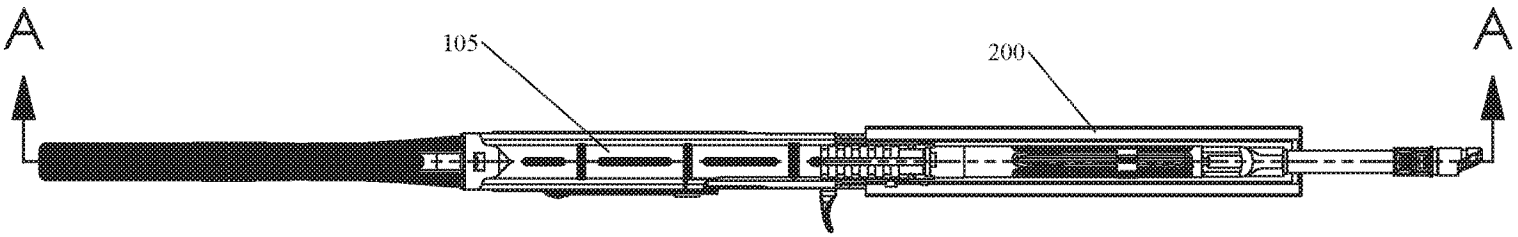
FIG. 12A illustrates a top view of the handguard system shown in FIG. 10.
Figure 12B:
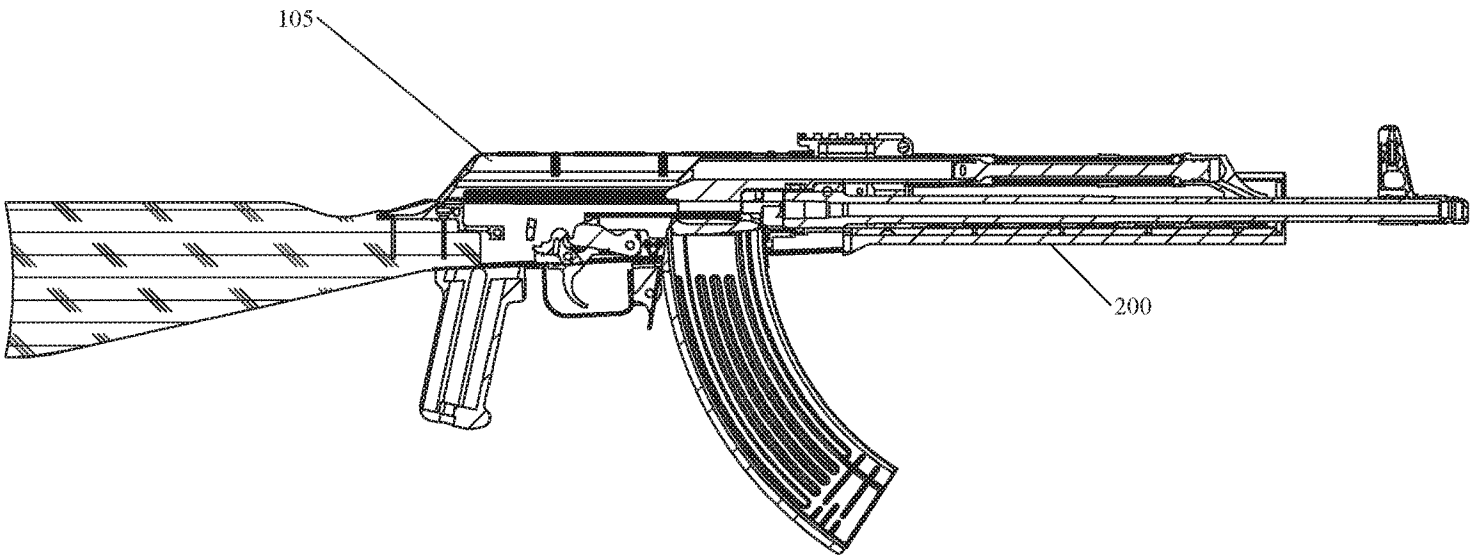
FIG. 12B illustrates a cross-sectional view of the handguard system, and the AK-type rifle on which it is mounted, taken along line A-A of FIG. 12A.

As shown in FIGS. 5B and 9A, in some implementations, the exterior sidewalls 141*a*, 141*b*, 141*c* defined by the handguard 140 provide surfaces that a user can ergonomically grip. In some implementations, the handguard 140 may include a channel through which the firearm barrel 110 extends (see, e.g., FIG. 4). In this way, forces applied to the handguard system 100 via the shooter's hand, a sling, or a bipod, for example, are not transmitted to the firearm barrel 110.

As shown in FIGS. 5A-5B, 9A, and 9C, in some implementations, the handguard 140 may be configured so that modular sections of MIL-STD-1913 mounting rail (or Picatinny rail) can be attached to various locations on the handguard 140 as needed to provide a mounting structure for MIL-STD-1913 rail mounted firearm accessories (e.g., an optic, light, laser, night vision device, foregrip, bipod, etc.). In some implementations, the handguard 140 may include one or more mounting slots 148 configured to support modular MIL-STD-1913 mounting rail sections that in turn support rail mounted firearm accessories. In some implementations, the one or more negative space mounting slots 148 may conform to the M-LOK standard and be configured to receive the T-slot nuts used therewith. In some implementations, the one or more negative space mounting slots 148 may conform to the KeyMod standard and include a larger diameter through-hole in combination with a narrow slot. In some implementations, the negative space mounting slots 148 may be replaced with one or more sections of MIL-STD-1913 mounting rail.

As shown in FIGS. 5A-5B, 7A, and 9A-9C, in some implementations, the handguard 140 may comprise a lower handguard section 142 and an upper handguard section 152. In some implementations, the handguard 140 may be a single unitary piece (i.e., the lower handguard section 142 and the upper handguard section 152 are a single piece of material). In some implementations, the upper handguard section 152 is configured so that it can be removably secured to the lower handguard section 142. In this way, by removing the upper handguard section 152, a user may gain access to the gas tube of an AK-type rifle.

As shown in FIGS. 5B and 9A, in some implementations, the lower handguard section 142 comprises a first end portion 142*a* that can be secured to the rear sight block 120, and an opposed second end portion 142*b* positioned near the front sight tower 112. In some implementations, the first end portion 142*a* of the lower handguard section 142 is configured to clamp onto the bottom portion 130 of the rear sight block 120 when secured thereto by suitable fasteners (e.g., threaded fasteners 160). In some implementations, threaded fasteners 160 pass through openings 150 in the sidewalls 141*a*, 141*b*, 141*c* of the handguard 140 and are threadedly received by corresponding openings 135 in the sidewalls 132*a*, 132*b*, 132*c* of the rear sight block 120 (see, e.g., FIGS. 5B, 7A-7B, and 9C). In this way, the handguard 140 may be removably secured to the rear sight block 120.

As shown in FIGS. 5A-5B and 9C, in some implementations, the first end portion 142*a* of the lower handguard section 142 may define a first interior sidewall 146*a*, a second interior sidewall 146*b*, and an interior bottom sidewall 146*c*. In some implementations, the first interior sidewall 146*a*, the second interior sidewall 146*b*, and the interior bottom sidewall 146*c* of the first end portion 142*a* of the handguard 140 may be configured to interface with the first sidewall 132*a*, the second sidewall 132*b*, and the bottom sidewall 132*c*, respectively, of the rear sight block 120 (see, e.g., FIG. 7B). In this way, the first end portion 142*a* of the lower handguard section 142 clamps onto the bottom portion 130 of the rear sight block 120 when the threaded fasteners 160 are tightened.

As shown in FIGS. 5B, 7B, and 9C, in some implementations, a first boss and a second boss extend from the first interior sidewall 146*a* and the second interior sidewall 146*b*, respectively, defined by the lower handguard section 142. In some implementations, each boss 144*a*, 144*b* may be a longitudinally extending protrusion. In some implementations, each boss 144*a*, 144*b* may have a rectangular shape. In some implementations, each boss 144*a*, 144*b* of the lower handguard section 142 may be any shape suitable for being received within a corresponding guide groove 134*a*, 134*b* of the rear sight block 120.

FIGS. 10-12B illustrate an AK-type firearm 105 equipped with another example handguard system 200 manufactured in accordance with the principles of the present disclosure. Except as noted below, the handguard system 200 is similar to the handguard system 100 discussed above.

Figure 13:
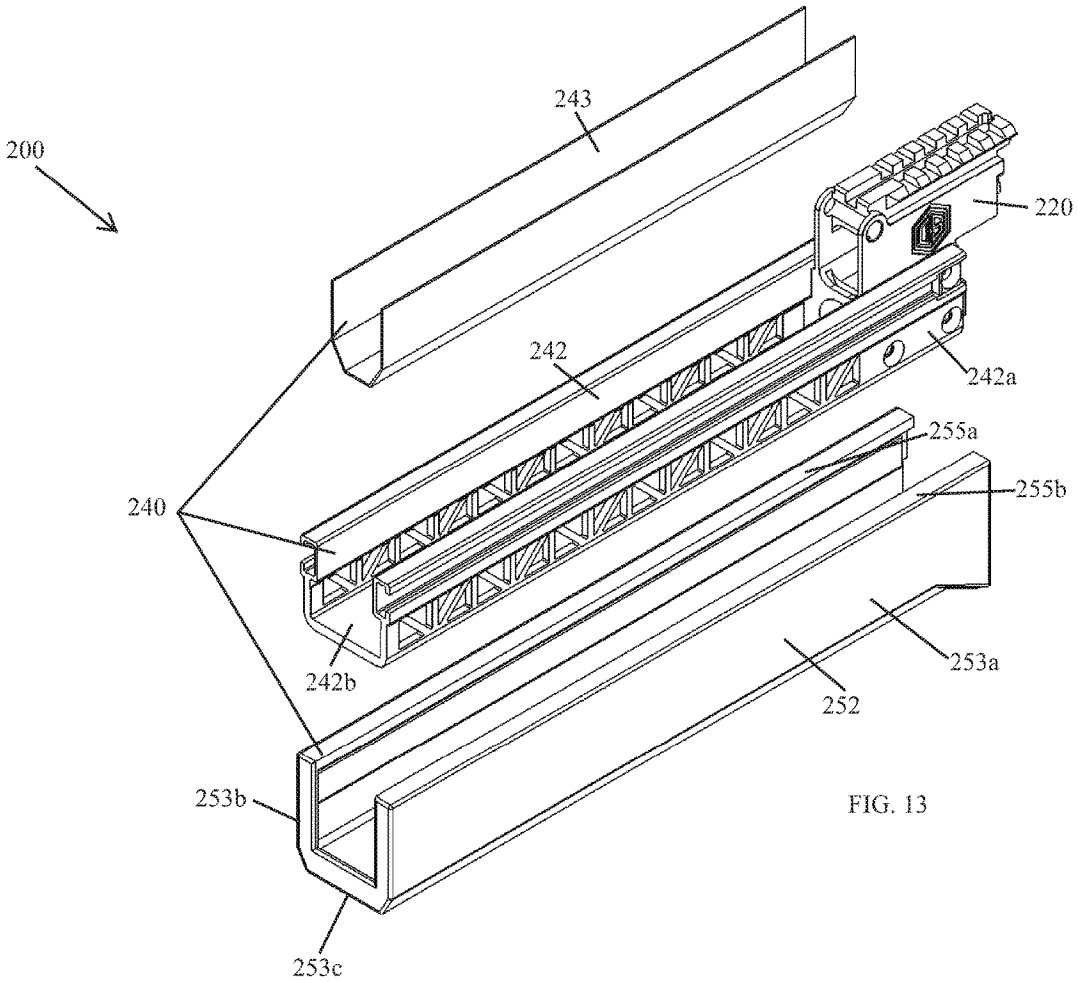
FIG. 13 illustrates an exploded view of the handguard system shown in FIG. 10, wherein the handguard system is not mounted on an AK-type rifle.

As shown in FIG. 13, in some implementations, the handguard system 200 may comprise a rear sight block 220 and a handguard 240 that can be removably secured thereto. In some implementations, the handguard 240 may comprise a handguard chassis 242, a heat shield 243, and a protective outer cover 252. In some implementations, the protective outer cover 252 of the handguard 240 can be removably secured to the handguard chassis 242 (see, e.g., FIGS. 10 and 13).

Figure 16:
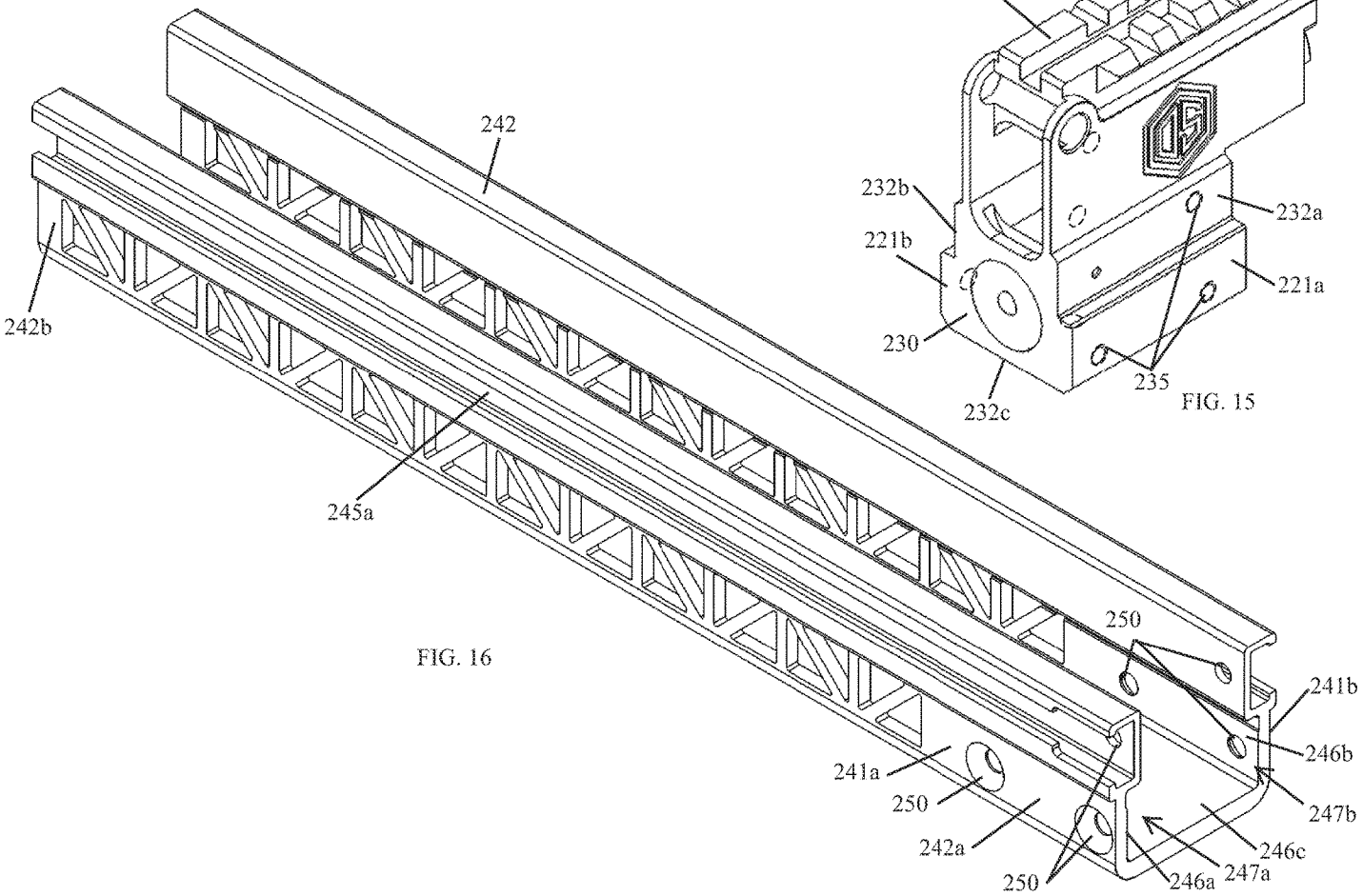
FIG. 16 illustrates a side perspective view of the handguard chassis shown in FIG. 13.
Figure 17A:
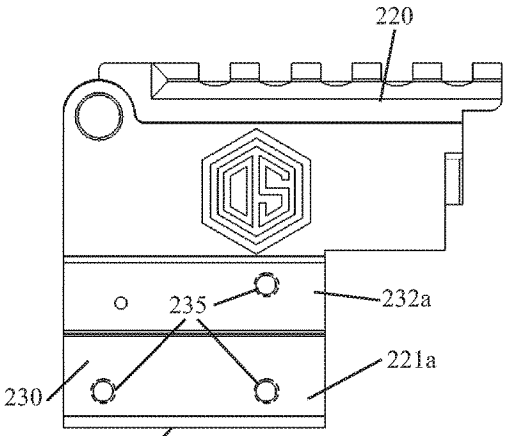
FIG. 17A illustrates a left side view of the rear sight block shown in FIG. 15.
Figure 17B:
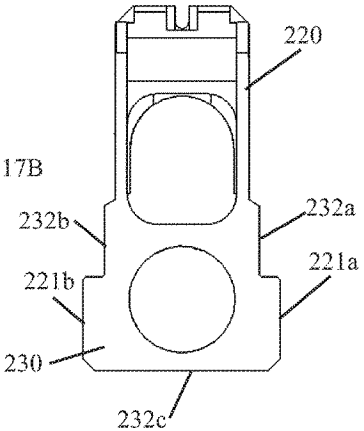
FIG. 17B illustrates a front end view of the rear sight block shown in FIG. 17A.
Figure 17C:
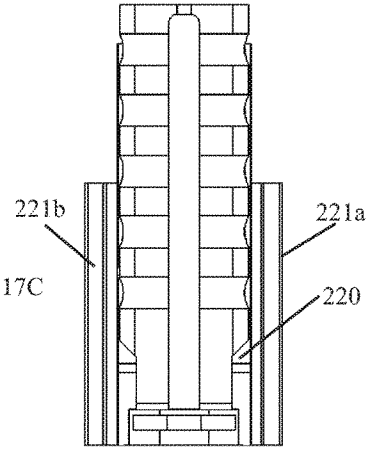
FIG. 17C illustrates a top view of the rear sight block shown in FIG. 17A.

As shown in FIGS. 17A-17C, in some implementations, the rear sight block 220 may include a first boss 221*a* and a second boss 221*b* that extend from the first sidewall 232*a* and the second sidewall 232*b*, respectively, of the bottom portion 230. In some implementations, each boss 221*a*, 221*b* may be a longitudinally extending protrusion. In some implementations, each boss 221*a*, 221*b* may have a rectangular shape. In some implementations, each boss 221*a*, 221*b* on the bottom portion 230 of the rear sight block 220 may be any shape suitable for being received within a corresponding guide groove 247*a*, 247*b* of the handguard chassis 242 (see, e.g., FIG. 16).

Figure 14C:
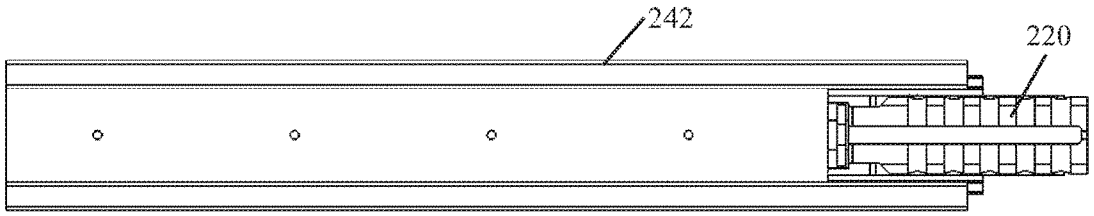
FIG. 14C illustrates a top view of the handguard system shown in FIG. 14A.
Figure 14A:
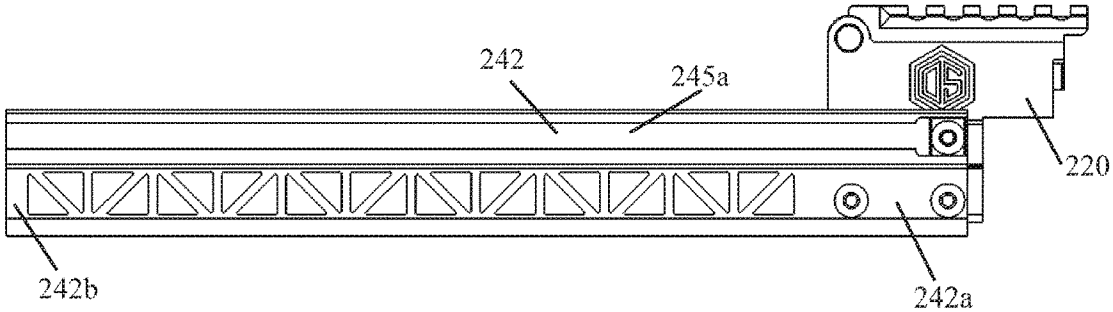
FIG. 14A illustrates a left side view of the handguard system shown in FIG. 13, wherein the heat shield and the outer cover are not shown.
Figure 14B:
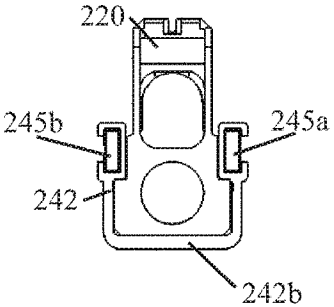
FIG. 14B illustrates a front end view of the handguard system shown in FIG. 14A.
Figure 15:
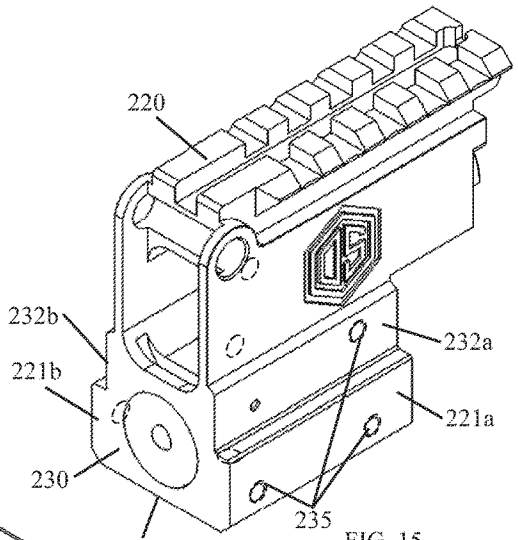
FIG. 15 illustrates a side perspective view of the rear sight block shown in FIG. 13.

As shown in FIGS. 13, 14A, and 16, in some implementations, the handguard chassis 242 may comprise a first end portion 242*a* that can be secured to the rear sight block 220, and an opposed second end portion 242*b* positioned near the front sight tower 112. In some implementations, the first end portion 242*a* of the handguard chassis 242 is configured to clamp onto the bottom portion 230 of the rear sight block 220 when secured thereto by suitable fasteners (e.g., threaded fasteners). In some implementations, threaded fasteners pass through openings 250 in the sidewalls 241*a*, 241*b*, 241*c* of the handguard chassis 242 and are threadedly received by corresponding openings 235 in the sidewalls 232*a*, 232*b*, 232*c* of the rear sight block 220 (see, e.g., FIGS. 15, 16, 18A, and 18C). In this way, the handguard chassis 242 may be removably secured to the rear sight block 220.

As shown in FIG. 16, in some implementations, the first end portion 242*a* of the handguard chassis 242 may define a first interior sidewall 246*a*, a second interior sidewall 246*b*, and an interior bottom sidewall 246*c*. In some implementations, the first interior sidewall 246*a* and the second interior sidewall 246*b* may include a first guide groove 247*a* and a second guide groove 247*b*, respectively. Each guide groove 247*a*, 247*b* is configured to receive therein a boss 221*a*, 221*b* extending from a sidewall 232*a*, 232*b* of the rear sight block 220 (see, e.g., FIG. 7B). In this way, the handguard 240 may be prevented from rotating and/or shifting when secured to the rear sight block 220. In some implementations, the first interior sidewall 246*a*, the second interior sidewall 246*b*, and the interior bottom sidewall 246*c* of the first end portion 242*a* of the handguard chassis 242 may be configured to interface with the first sidewall 232*a*, the second sidewall 232*b*, and the bottom sidewall 232*c*, respectively, of the rear sight block 220 (see, e.g., FIG. 14A). In this way, the first end portion 242*a* of the handguard chassis 242 clamps onto the bottom portion 230 of the rear sight block 220 when the threaded fasteners are tightened.

Figure 18C:
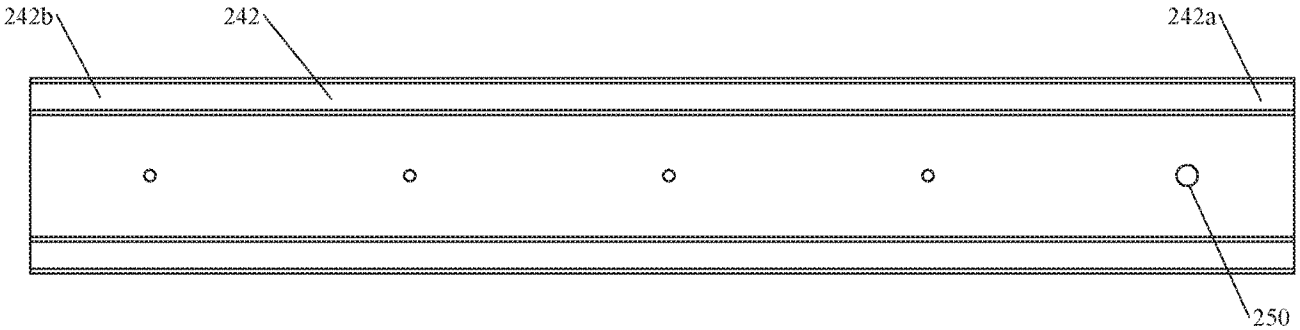
FIG. 18C illustrates a top view of the handguard chassis shown in FIG. 18A.
Figure 18A:
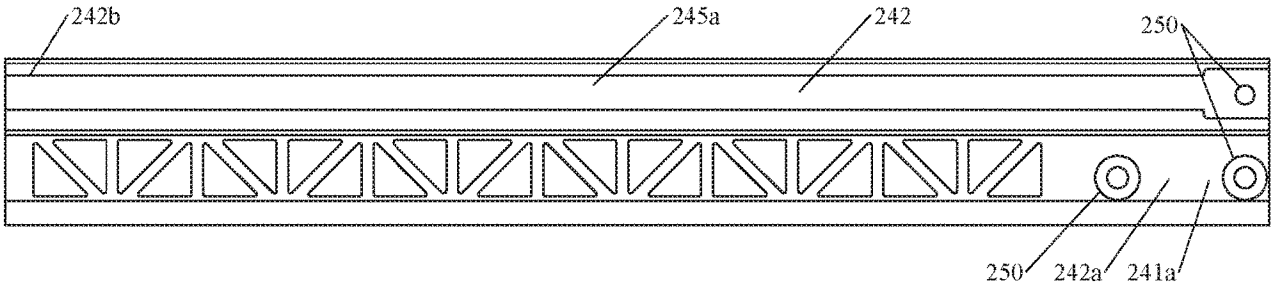
FIG. 18A illustrates a left side view of the handguard chassis shown in FIG. 16.
Figure 18B:
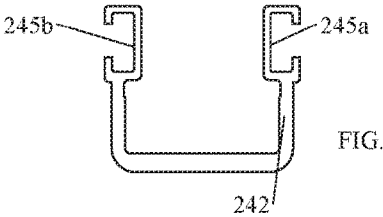
FIG. 18B illustrates a front end view of the handguard chassis shown in FIG. 18A.

As shown in FIGS. 16 and 18B, in some implementations, the handguard chassis 242 may further comprise a first and a second longitudinally extending channel 245*a*, 245*b*. In some implementations, the longitudinally extending channels 245 may be configured to facilitate the attachment of the protective outer cover 252 to the handguard chassis 242.

As shown in FIG. 13, in some implementations, the handguard chassis 242 may further comprise a heat shield 243 having a longitudinally extending U-shaped body. In some implementations, the heat shield 243 may be configured to act as a thermal break and insulate the protective outer cover 252 from heat radiating from the firearm barrel 110. In some implementations, there may be a coating between the heat shield 243 and the handguard chassis 242 that acts as a thermal barrier (not shown).

As shown in FIG. 13, in some implementations, the exterior defined by the sidewalls 253*a*, 253*b*, 253*c* of the protective outer cover 252 provide surfaces that a user can ergonomically grip. In some implementations, the first sidewall 253*a* and the second sidewall 253*b* of the protective outer cover 252 may further comprise a first flange 255*a* and a second flange 255*b*, respectively, extending inwardly therefrom. In some implementations, the first flange 255*a* and the second flange 255*b* of the protective outer cover 252 are configured to be removably received within the first longitudinally extending channel 245*a* and the second longitudinally extending channel 245*b*, respectively, of the handguard chassis 242.

FIGS. 19-22 illustrate an AK-type firearm 105 equipped with yet another example handguard system 300 manufactured in accordance with the principles of the present disclosure. In some implementations, the handguard system 300 is similar to the handguard systems 100, 200 discussed above, in particle the handguard system 100 shown in FIGS. 5A-9C, but further comprises a heat shield 370 that is secured to the interior of the lower handguard section 342, and a front cap 380 that is secured to the distal end of the handguard 340.

Figure 19:
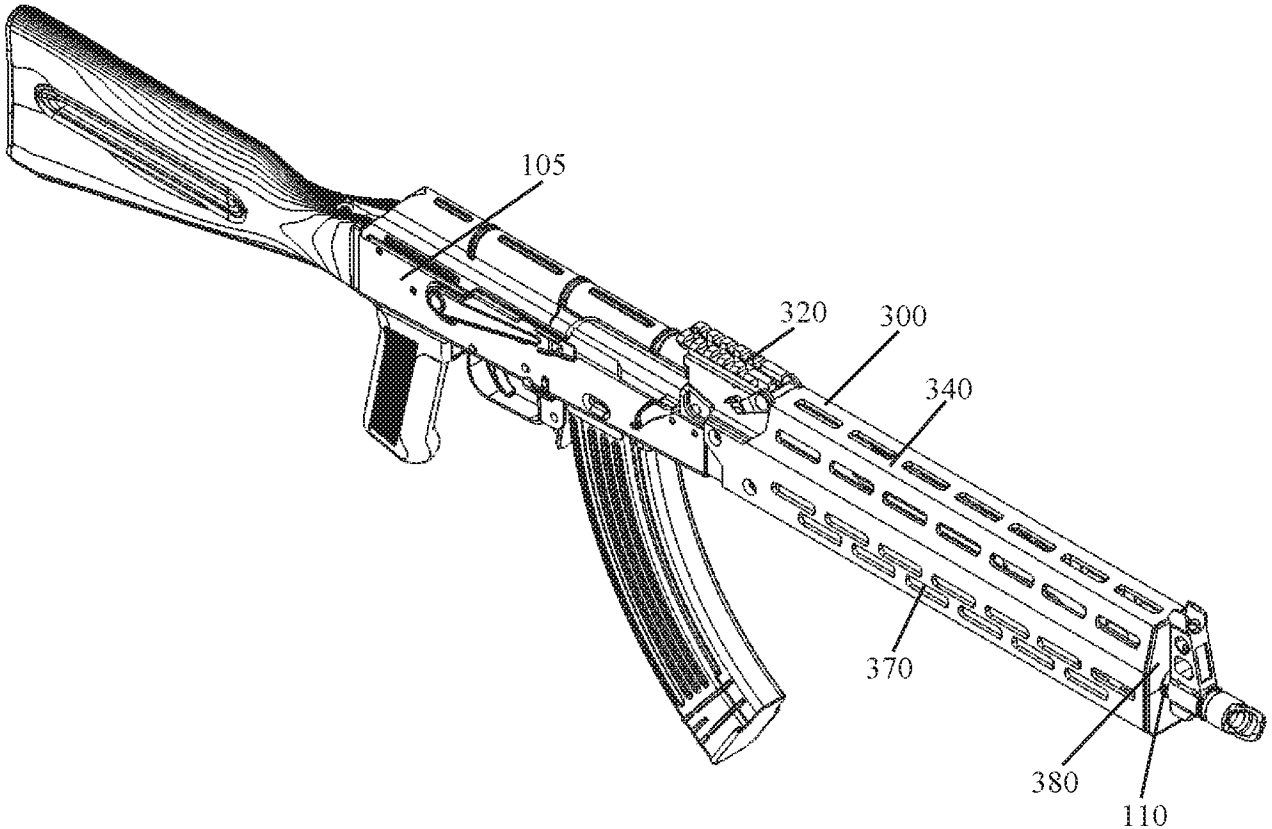
FIG. 19 illustrates a side perspective view of yet another example handguard system manufactured in accordance with the principles of the present disclosure, wherein the handguard system is mounted on an AK-type rifle.
Figure 20:
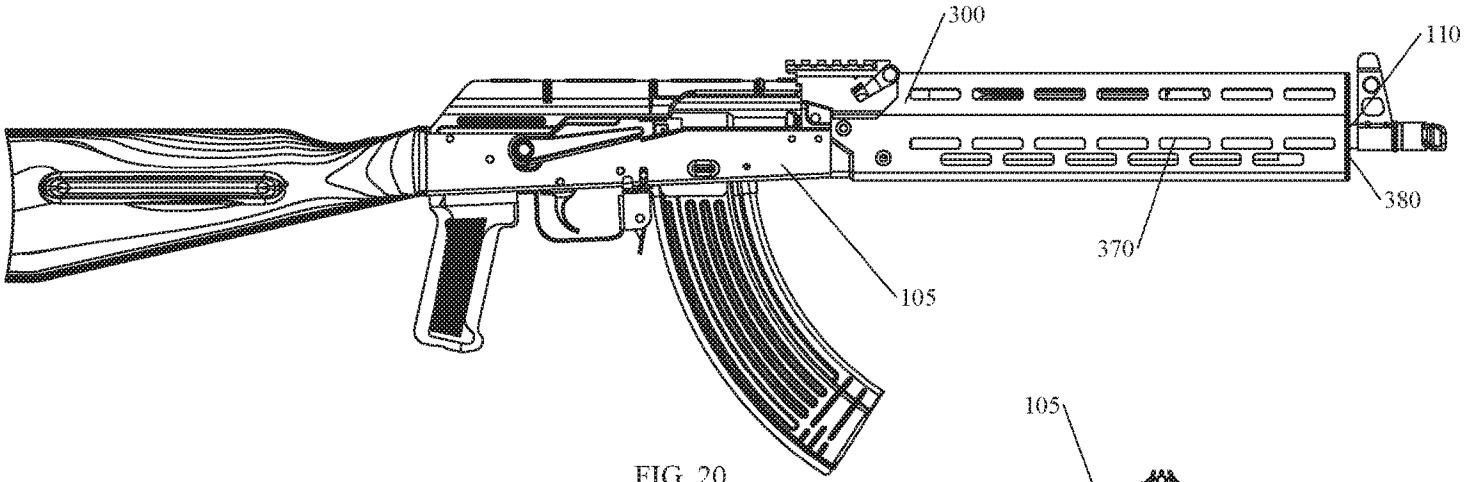
FIG. 20 illustrates a right side view of the example handguard system shown in FIG. 19.
Figure 22:
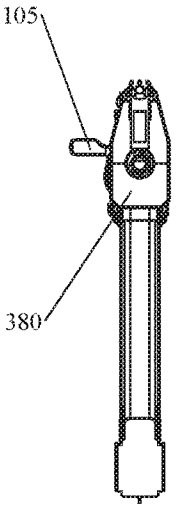
FIG. 22 illustrates a front end view of the handguard system shown in FIG. 19.
Figure 21A:
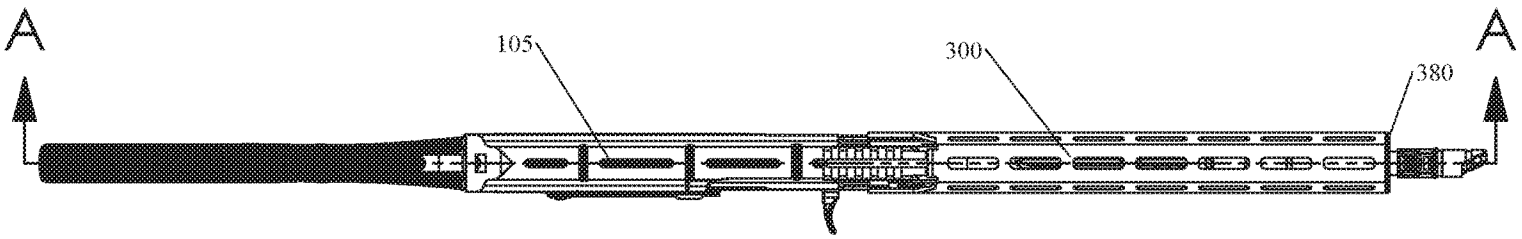
FIG. 21A illustrates a top view of the handguard system shown in FIG. 19.
Figure 21B:
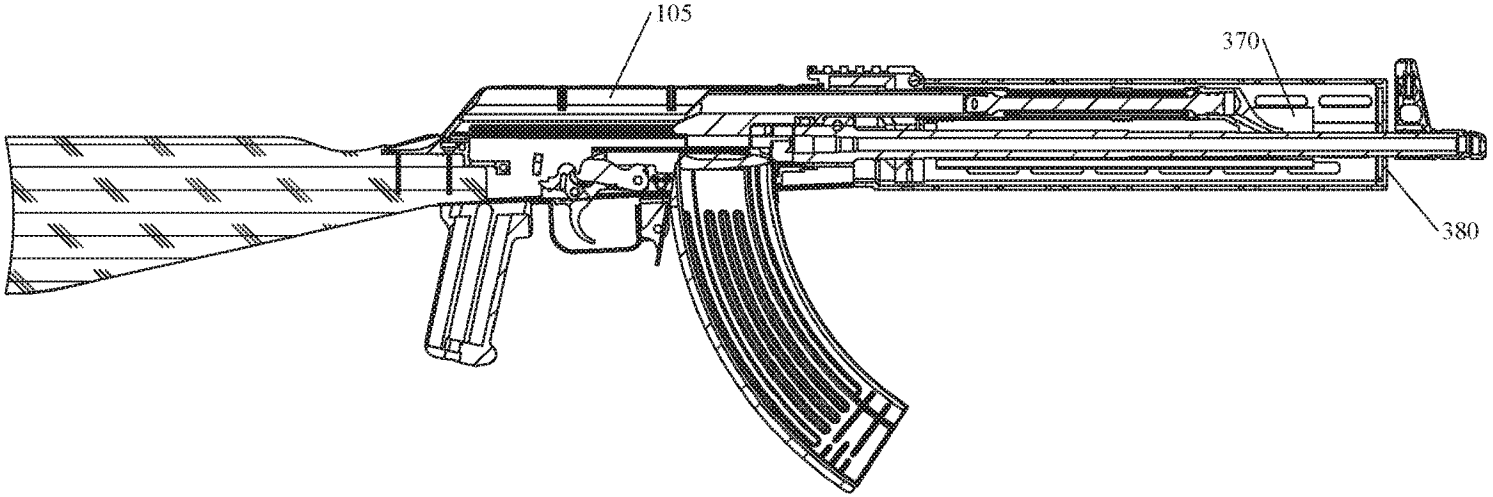
FIG. 21B illustrates a cross-sectional view of the handguard system, and the AK-type rifle on which it is mounted, taken along line A-A of FIG. 21A.
Figure 23A:
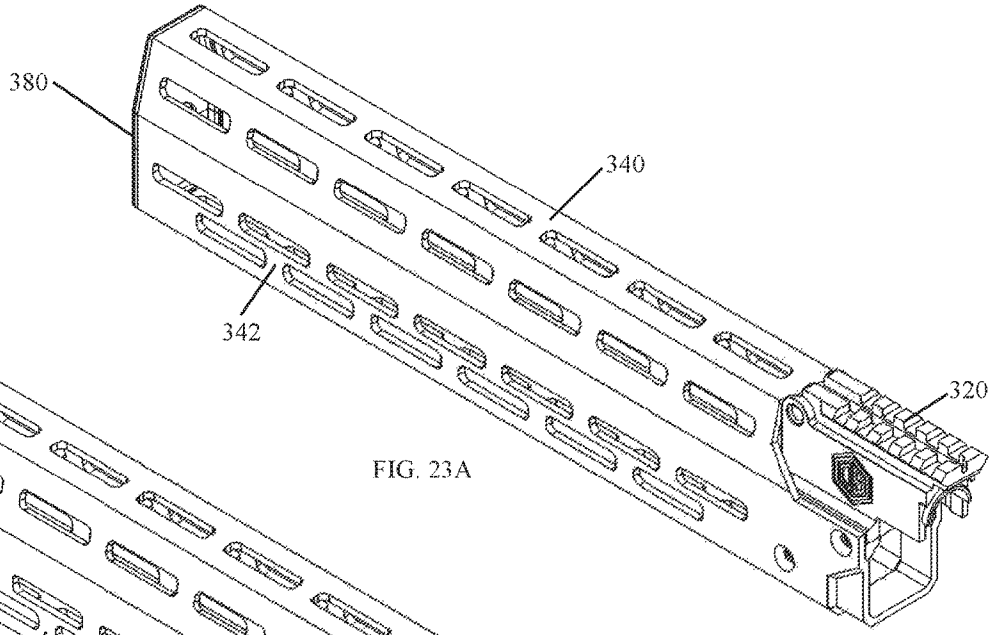
FIG. 23A illustrates a side perspective view of the handguard system shown in FIG. 19, wherein the handguard system is not mounted on an AK-type rifle.
Figure 23B:
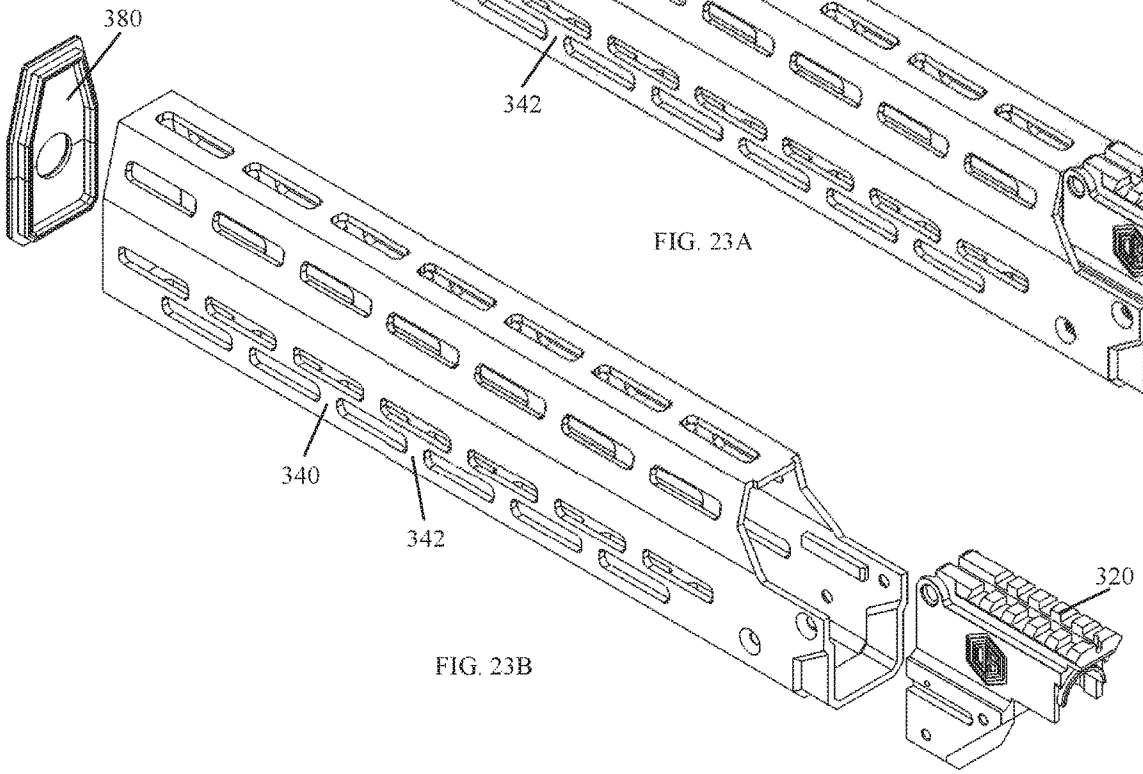
FIG. 23B illustrates an exploded view of the handguard system shown in FIG. 23A.
Figure 24B:
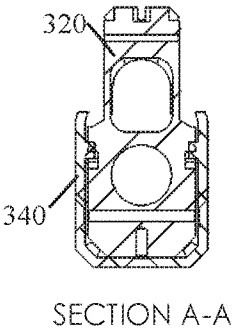
FIG. 24B illustrates a cross-sectional view of the handguard system taken along line A-A of FIG. 24A.
Figure 25:
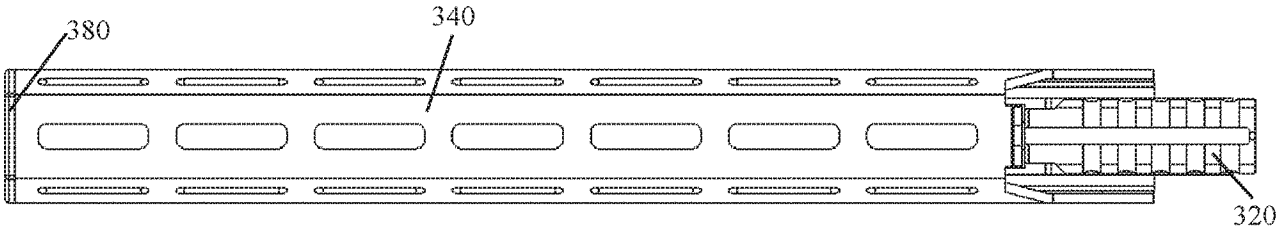
FIG. 25 illustrates a top view of the handguard system shown in FIG. 23A.
Figure 24A:
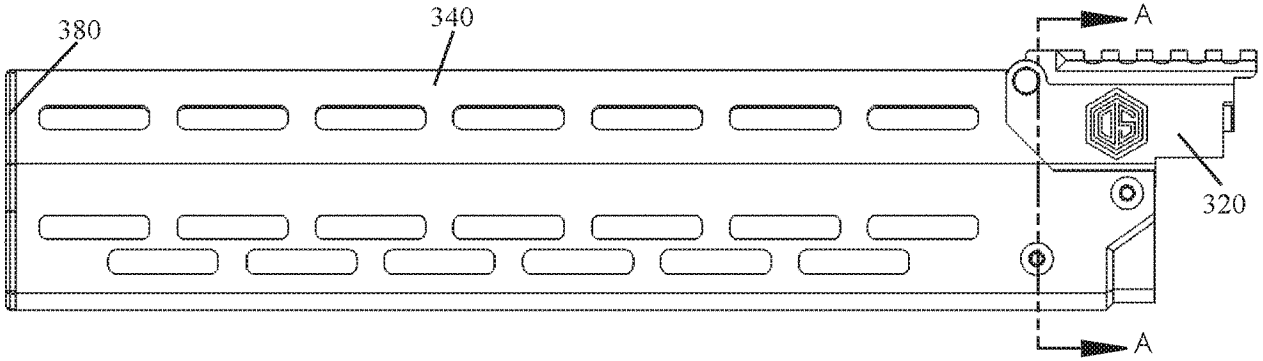
FIG. 24A illustrates a left side view of the handguard system shown in FIG. 23A.
Figure 26C:
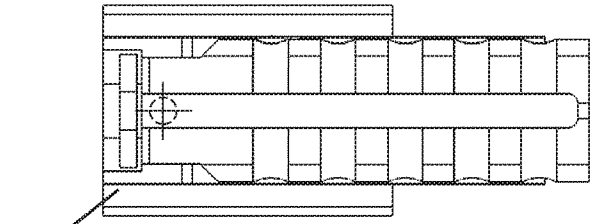
FIG. 26C illustrates a top view of the rear sight block shown in FIG. 26A.
Figure 26A:
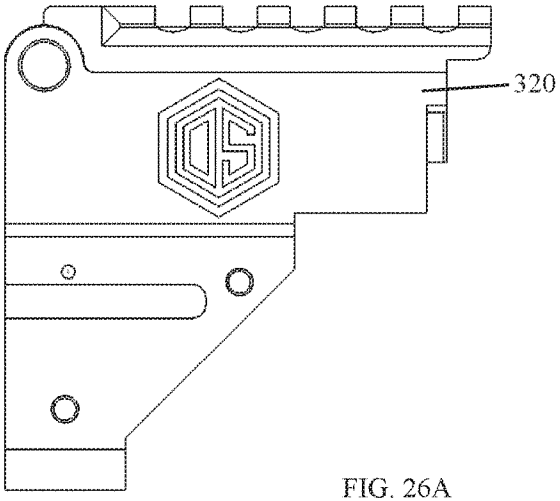
FIG. 26A illustrates a left side view of the rear sight block shown in FIG. 23B.
Figure 26B:
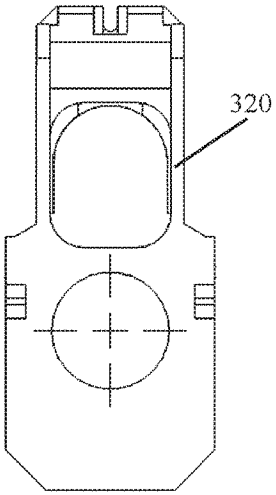
FIG. 26B illustrates a front end view of the rear sight block shown in FIG. 26A.
Figure 27C:
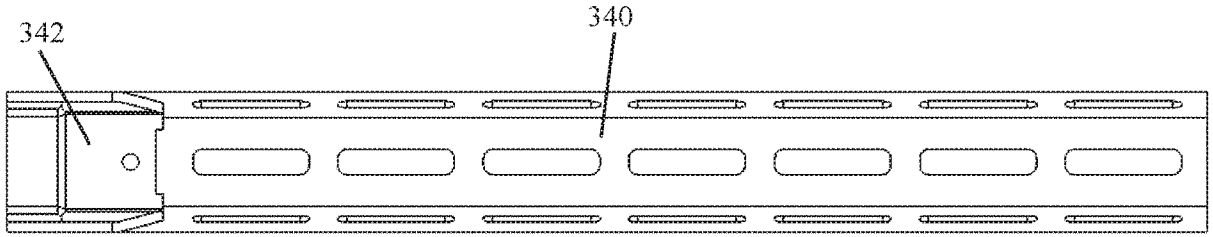
FIG. 27C illustrates a top view of the handguard shown in FIG. 27A.
Figure 27A:
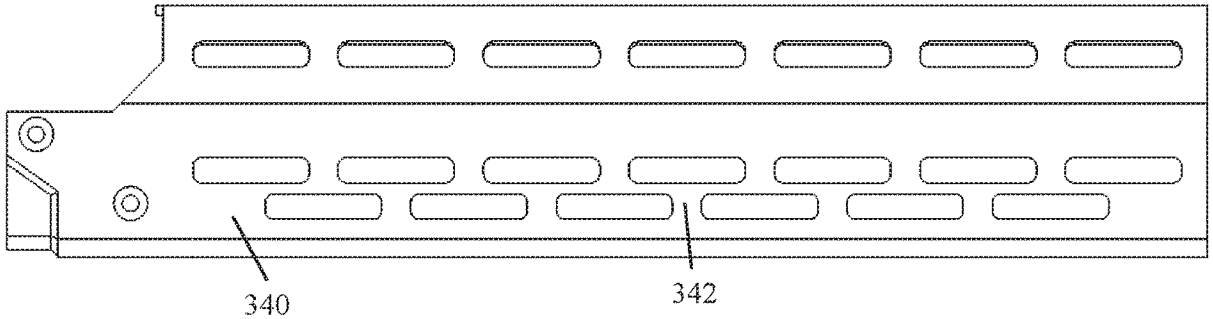
FIG. 27A illustrates a right side view of the handguard shown in FIG. 23B.
Figure 27B:
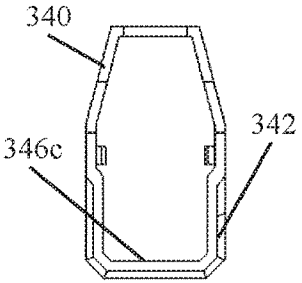
FIG. 27B illustrates a front end view of the handguard shown in FIG. 27A.
Figure 29A:
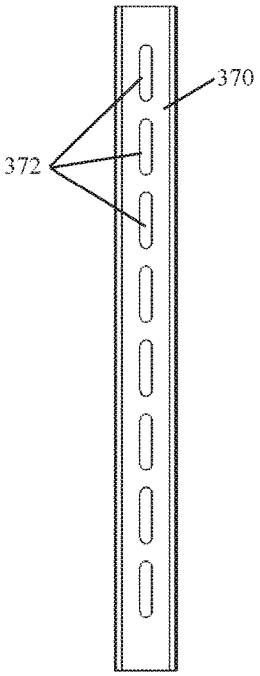
FIG. 29A illustrates a top view of a heat shield manufactured in accordance with the principles of the present disclosure.
Figure 29B:
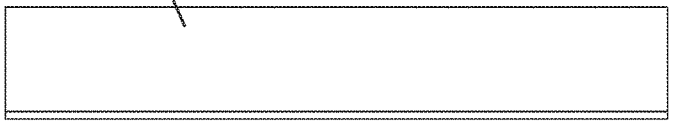
FIG. 29B illustrates a side view of the heat shield shown in FIG. 29A.
Figure 29C:
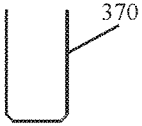
FIG. 29C illustrates an end view of the heat shield shown in FIG. 29A.
Figure 30:
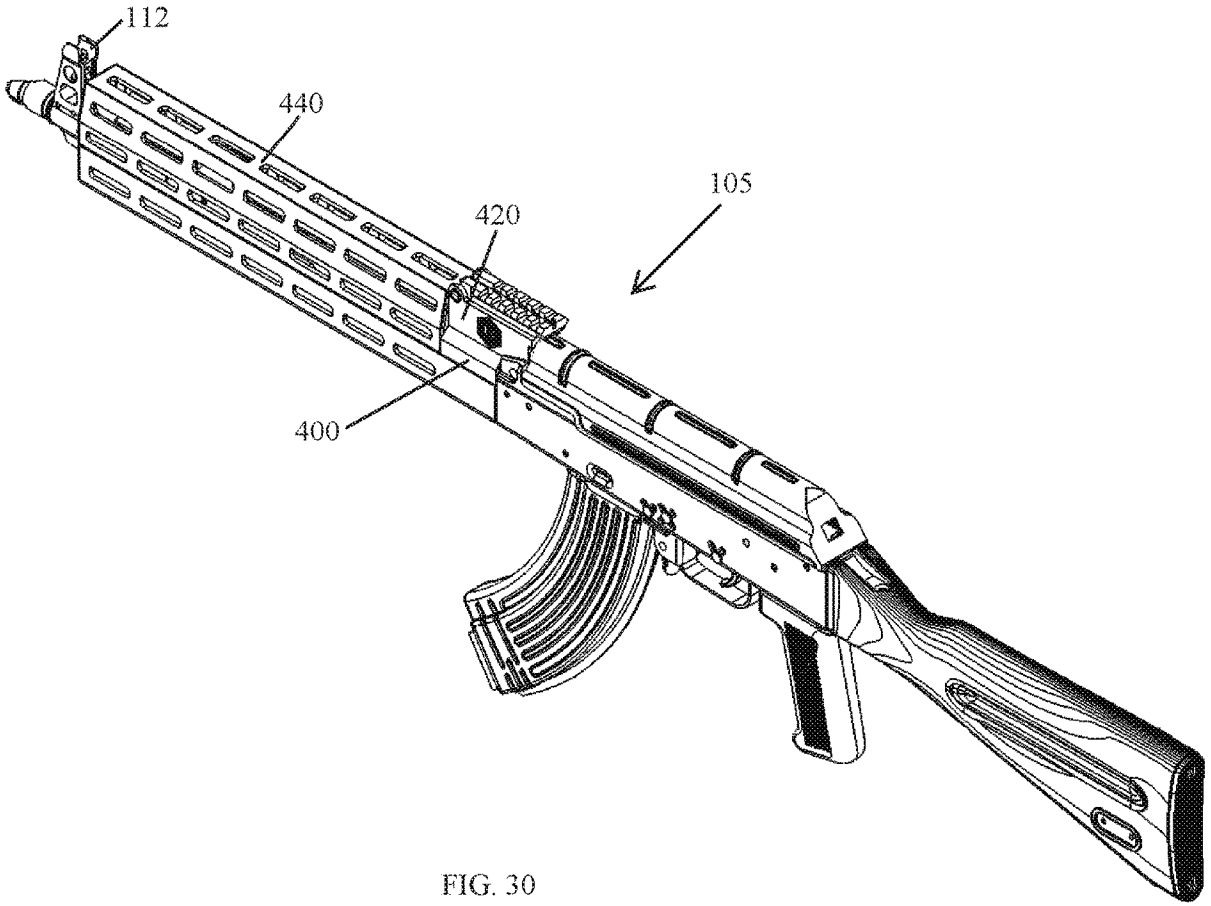
FIG. 30 illustrates a side perspective view of still yet another example handguard system manufactured in accordance with the principles of the present disclosure, wherein the handguard system is mounted on an AK-type rifle.
Figure 31:
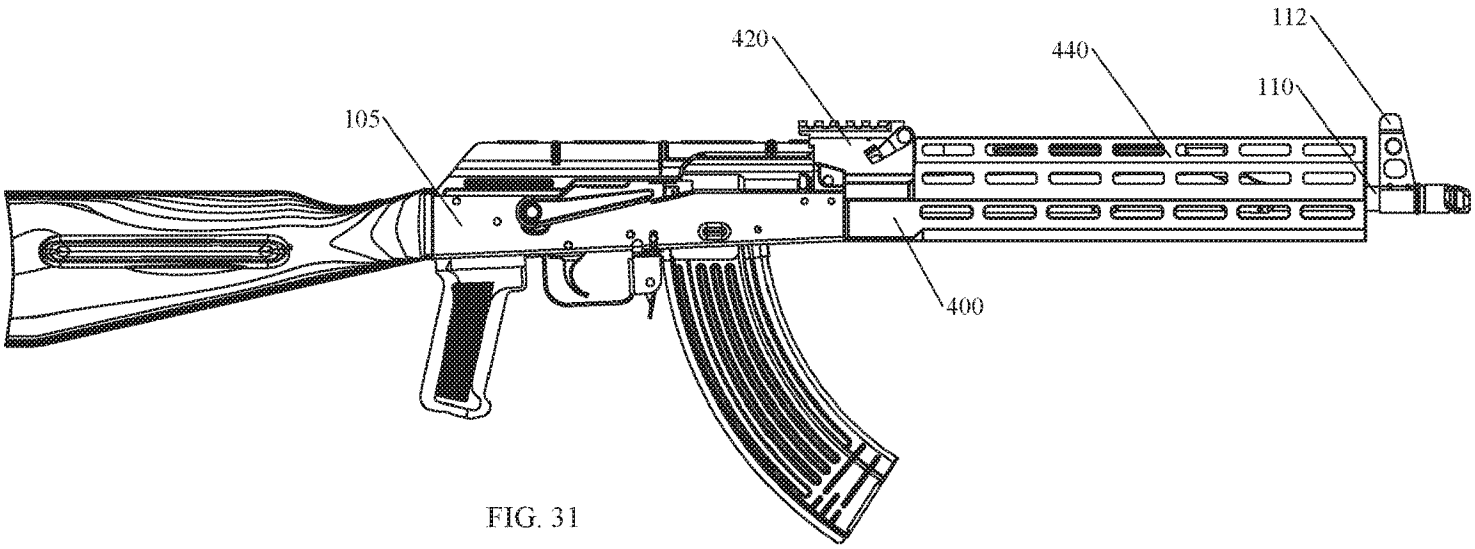
FIG. 31 illustrates a right side view of the example handguard system shown in FIG. 30.
Figure 32A:
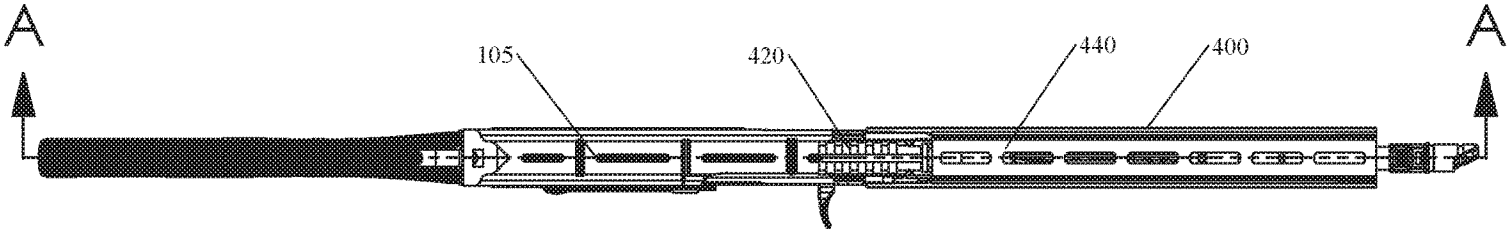
FIG. 32A illustrates a top view of the handguard system shown in FIG. 30.
Figure 32B:
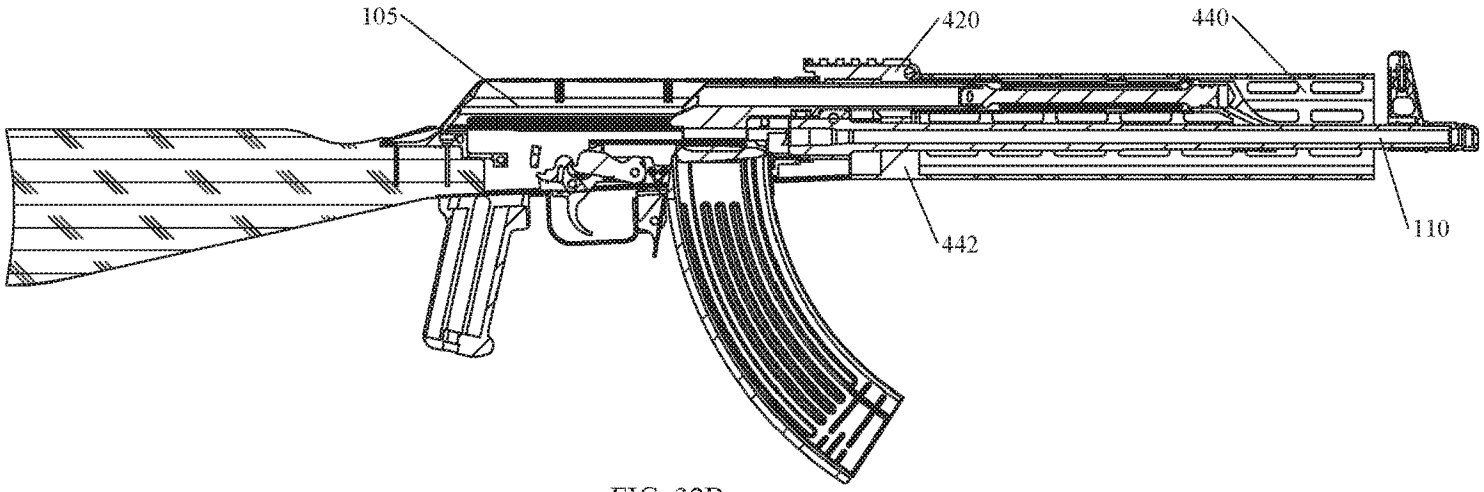
FIG. 32B illustrates a cross-sectional view of the handguard system, and the AK-type rifle on which it is mounted, taken along line A-A of FIG. 32A.

As shown in FIGS. 19 and 20, in some implementations, the heat shield 370 of the handguard system 300 may be configured to reflect heat emanating from a firearm barrel 110 and thereby protect the user's hand from injury. In some implementations, the heat shield 370 may comprise an elongated body having a U-shaped lateral cross-section (e.g., FIGS. 29A-29C). In some implementations, the bottom sidewall of the heat shield 370 may include several longitudinally spaced slots 372 (e.g., eight). In this way, air may circulate through the slots 372 and thereby cool the firearm barrel 110. In some implementations, the heat shield 370 may not include the slots 372.

In some implementations, the heat shield 370 may be secured to the interior bottom sidewall 346*c* defined by the handguard 340. In some implementations, the bottom sidewall of the heat shield 370 may be offset from the interior bottom sidewall 346*c* of the handguard 340 by one or more spacers (e.g., a washer). In some implementations, one or more fasteners, each extending through a spacer, may be used to secure the heat shield 370 to the lower handguard section 342. In this way, as heat emanating from the firearm barrel 110 warms the heat shield 370, heat emanating from the heat shield 370 is not readily transferred to the handguard 340.

As shown in FIG. 19, in some implementations, the front cap 380 of the handguard system 300 may be configured to minimize deflection of the handguard 340.

Figure 28B:
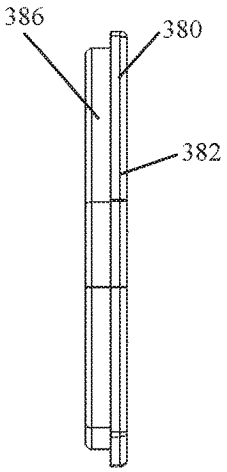
FIG. 28B illustrates a right side view of the front cap shown in FIG. 28A.
Figure 28C:
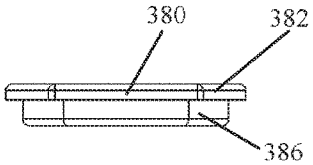
FIG. 28C illustrates a top view of the front cap shown in FIG. 28A.
Figure 28A:
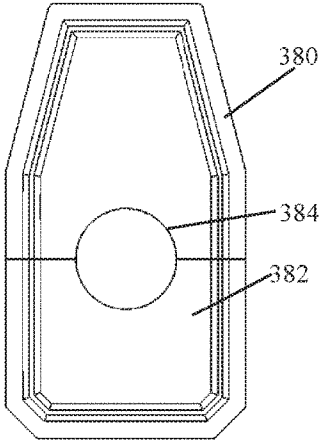
FIG. 28A illustrates a back view of the front cap shown in FIG. 23B.

As shown in FIGS. 28A-28C, in some implementations, the front cap 380 comprises a body portion 382 having an opening 384 extending therethrough, and a sidewall 386 extending outwardly from the body portion 382. In some implementations, the opening 384 in the front cap 380 is larger in diameter than the barrel 110 of the firearm on which the handguard system 300 is to be mounted. In this way, the handguard 340 remains free floating because the firearm barrel 110 can extend through the opening 384 without making contact therewith. In some implementations, the deflection of the handguard 340 may be limited by the opening 384 in the front cap 380; the range of deflection allowed by the front cap 380 is a function of the interior diameter of the opening 384 and the exterior diameter of the firearm barrel 110.

In some implementations, the front cap 380 may be removably secured to the distal end of the handguard 340. In some implementations, the front cap 380 may be secured to the distal end of the handguard 340 by one or more fasteners. In some implementations, the front cap 380 may be configured to be press-fit onto the distal end of the handguard 340 (e.g., the sidewall 386 of the front cap 380 may be configured to make frictional engagement with the interior sidewalls adjacent the distal end of the handguard 340).

FIGS. 30-32B illustrate an AK-type firearm 105 equipped with still yet another example handguard system 400 manufactured in accordance with the principles of the present disclosure. In some implementations, the handguard system 400 is similar to the handguard systems 100, 200, 300 discussed above but comprises a rear sight block 420 and a handguard 440 that can be removably secured together and thereby form a clamp that secures the handguard system 400 to the barrel of a rifle 105.

As shown in FIG. 33A-33D, the handguard system 400 may comprise a rear sight block 420 configured to be removably affixed to the lower handguard section 442, and an upper handguard section 452 that is configured to be removably affixed to the lower handguard section 442. In some implementations, a portion of the rear sight block 420 and the lower handguard section 442, together, form a clamp 426 that is configured to affix the handguard system 440 to the barrel 110 of an AK-type rifle (see, e.g., FIGS. 32B and 33D). In some implementations, the clamp 426 formed by the rear sight block 420 and the lower handguard section 442 is configured to serve the same function as the sleeve found on prior art rear sight blocks used with AK-type rifles. In this way, the handguard system 400 may be precisely positioned and rigidly secured to the barrel 110 of an AK-type rifle 105.

Figure 34C:
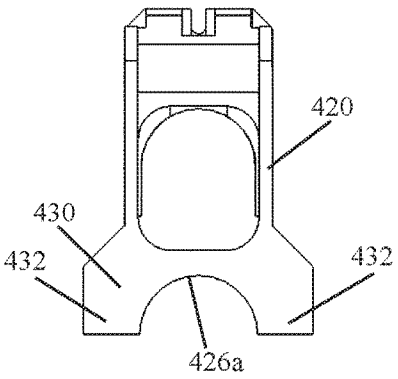
FIG. 34C illustrates a front end view of the rear sight block shown in FIG. 34A.
Figure 34B:
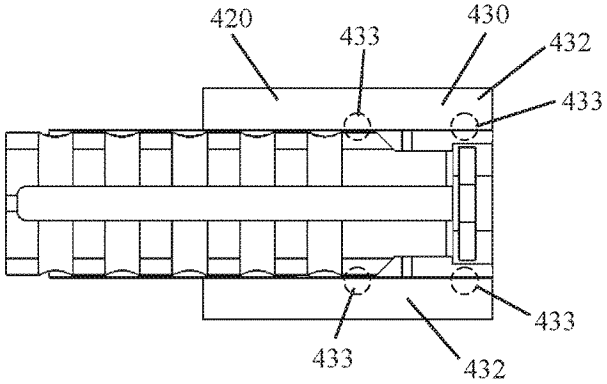
FIG. 34B illustrates a top view of the rear sight block shown in FIG. 34A.
Figure 34A:
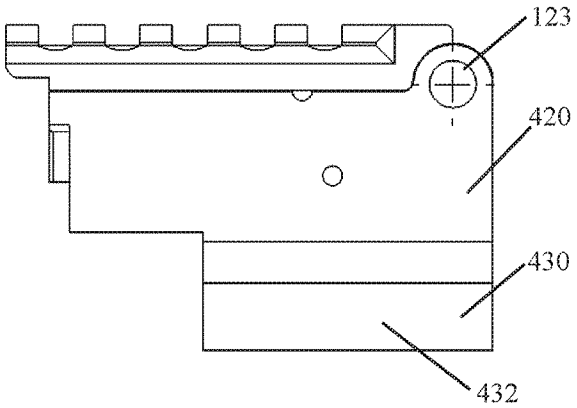
FIG. 34A illustrates a right side view of the rear sight block shown in FIG. 33A.
Figure 35B:
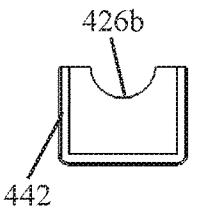
FIG. 35B illustrates a rear end view of the lower handguard section shown in FIG. 35A.
Figure 35C:
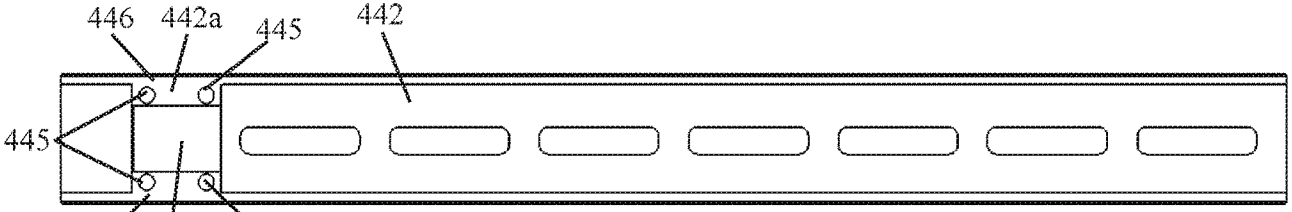
FIG. 35C illustrates a top view of the lower handguard section shown in FIG. 35A.
Figure 35A:
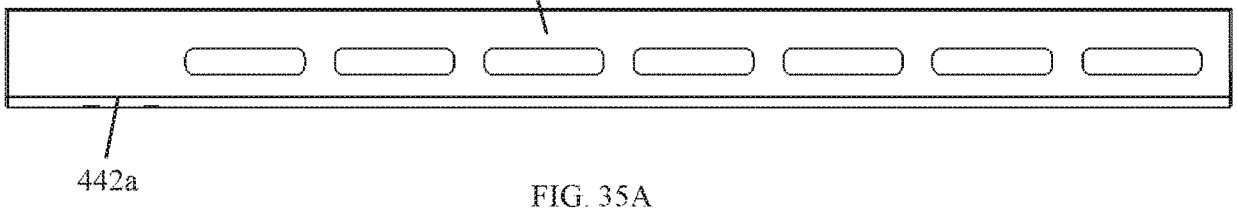
FIG. 35A illustrates a right side view of the lower handguard section shown in FIG. 33A.

As shown in FIGS. 34C, 35B, and 35C, in some implementations, the bottom side 430 of the rear sight block 420 and the first end portion 442*a* of the lower handguard section 442 include clamp jaws 426*a*, 426*b* configured to cooperatively engage with the outer surface of the firearm barrel 110. In some implementations, each clamp jaw 426*a*, 426*b* may be a semi-circular surface that corresponds to a portion of the diameter of a firearm barrel 110. In some implementations, fasteners (e.g., screws) extend through aligned openings 433, 445 in the flanges 432 of the rear sight block 420 and the opposing sidewalls 446 of the lower handguard section 442 to draw the clamp jaws 426*a*, 426*b* together. In this way, the rear sight block 420 and the lower handguard section 442 may be affixed (i.e., clamped) to the barrel 110 of an AK-type rifle 105 (see, e.g., FIG. 32B).

Figure 36C:
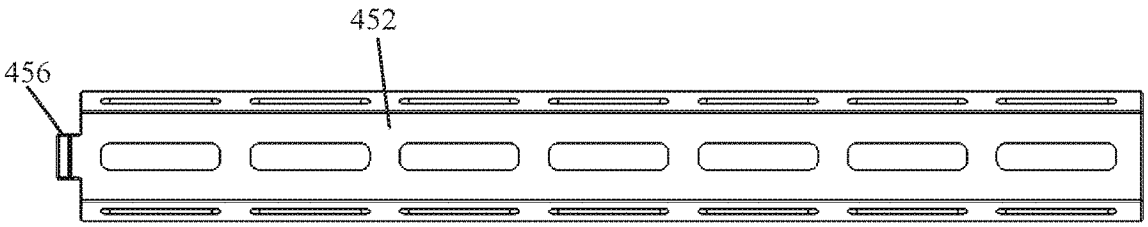
FIG. 36C illustrates a top view of the upper handguard section shown in FIG. 36A.
Figure 36A:
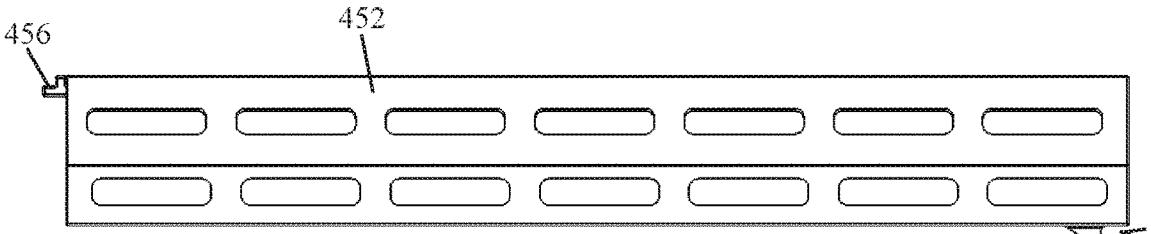
FIG. 36A illustrates a right side view of the upper handguard section shown in FIG. 33A.
Figure 36B:
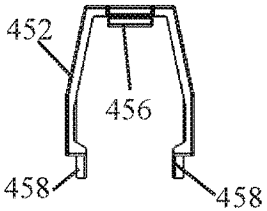
FIG. 36B illustrates a rear end view of the upper handguard section shown in FIG. 36A.
Figure 37:
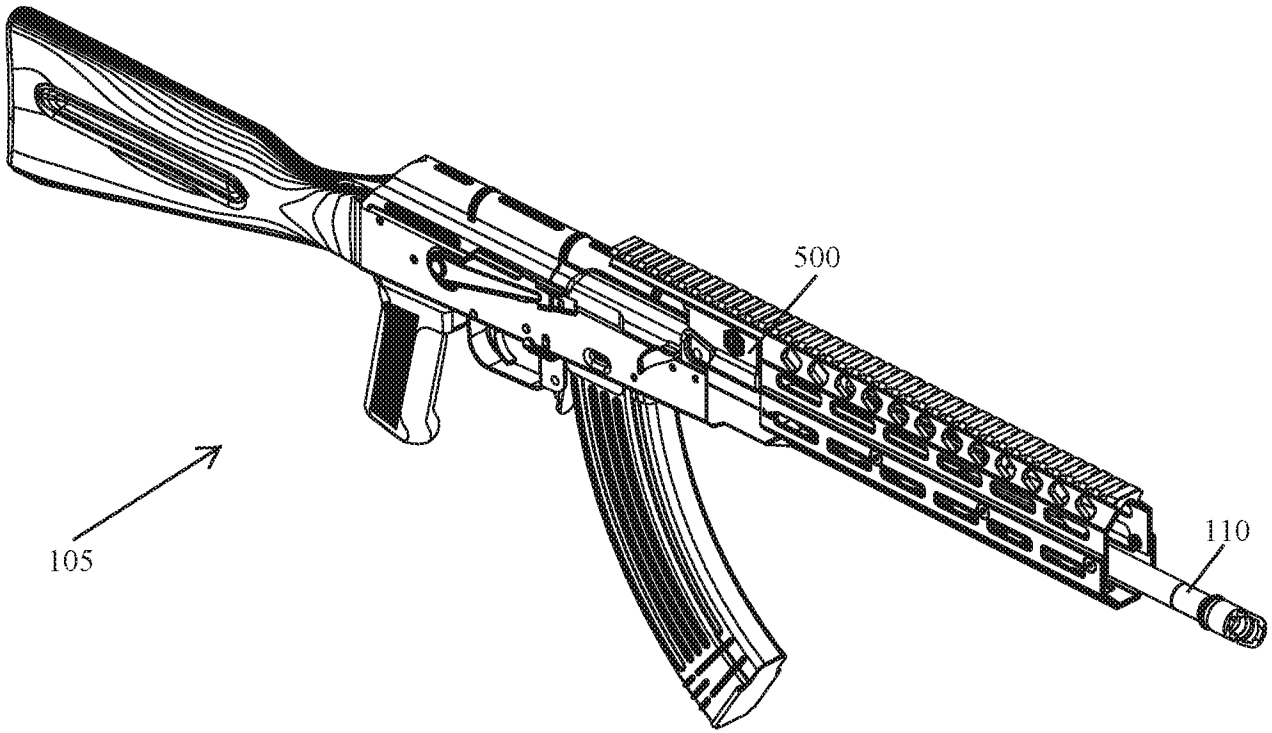
FIG. 37 illustrates a side perspective view of yet another example handguard system manufactured in accordance with the principles of the present disclosure, wherein the handguard system is mounted on an AK-type rifle.
Figure 38:
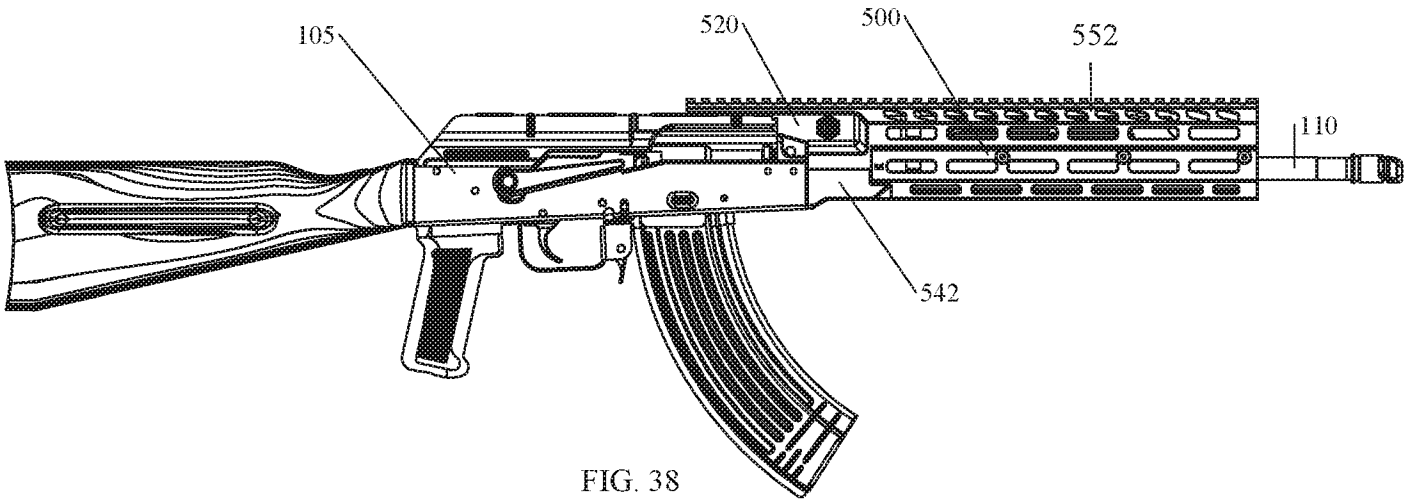
FIG. 38 illustrates a right side view of the example handguard system shown in FIG. 37.
Figure 39A:
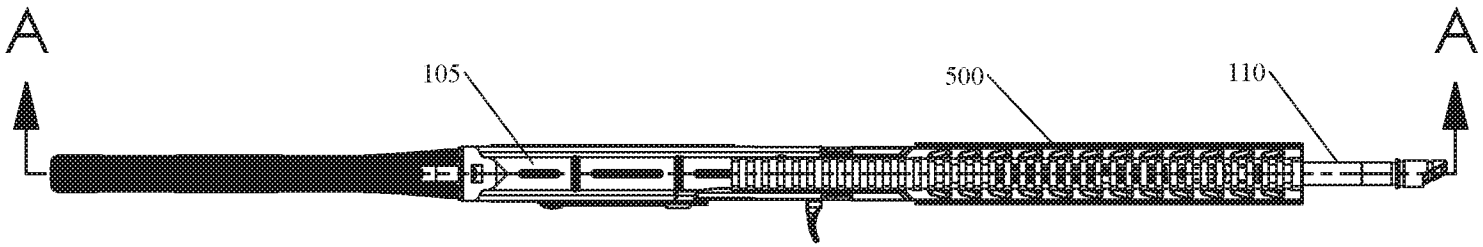
FIG. 39A illustrates a top view of the handguard system shown in FIG. 37.
Figure 39B:
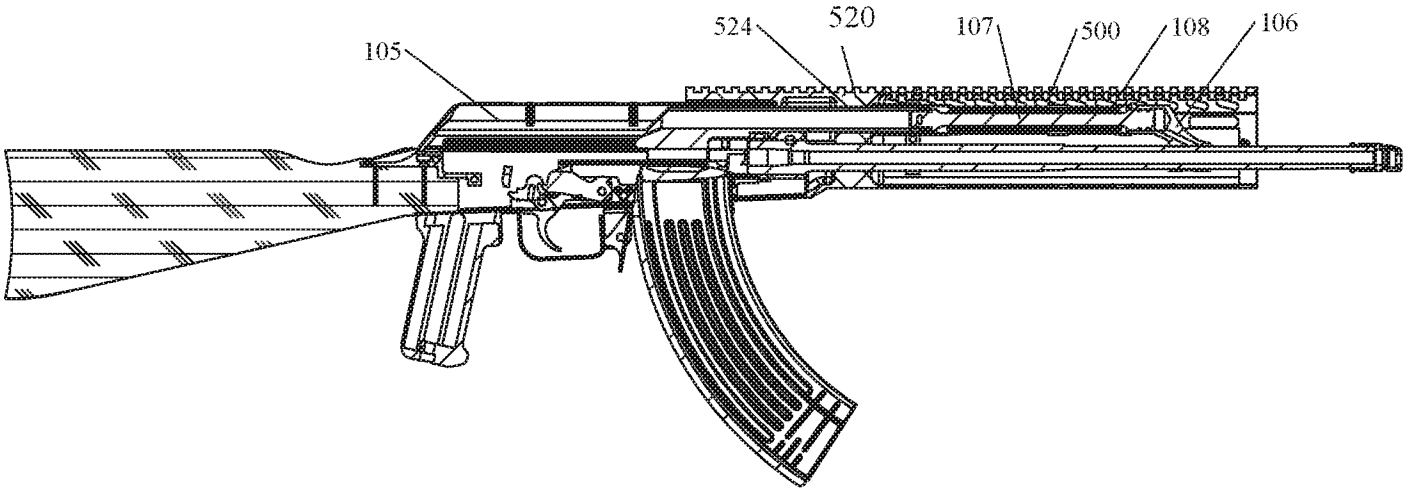
FIG. 39B illustrates a cross-sectional view of the handguard system, and the AK-type rifle on which it is mounted, taken along line A-A of FIG. 39A.

As shown in FIGS. 36A-36C, in some implementations, the upper handguard section 452 may further comprise a rectangular flange 456 that extends rearwardly from the top sidewall 454 thereof, and two arms 458 positioned for cooperative engagement with two mating projections 447 extending inwardly from opposing sidewalls of the lower handguard section 442. In some implementations, the upper handguard section 452 may not include the rectangular flange 456.

Figure 33A:
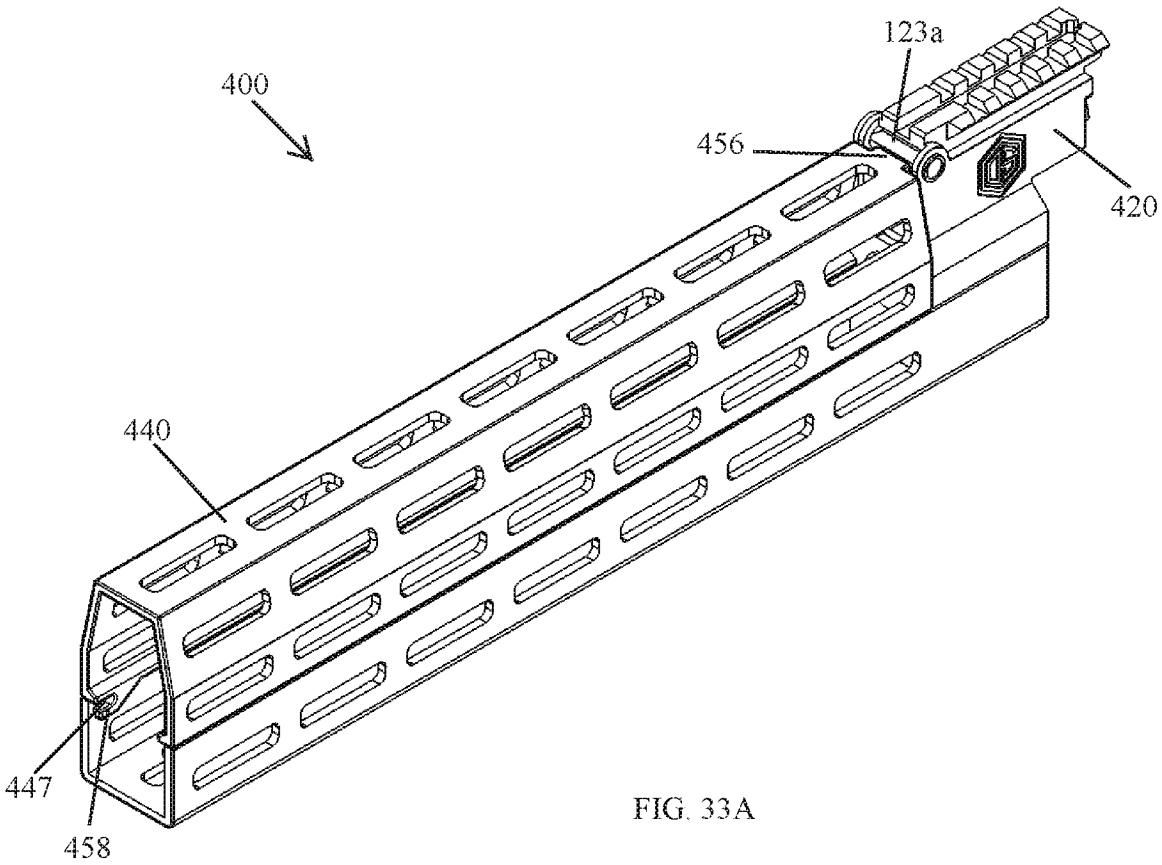
FIG. 33A illustrates a side perspective view of the handguard system shown in FIG. 30, wherein the handguard system is not mounted on an AK-type rifle.
Figure 33B:
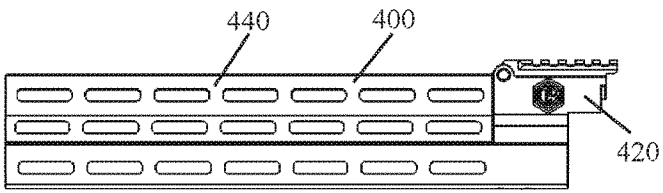
FIG. 33B illustrates a left side view of the handguard system shown in FIG. 33A.
Figure 33C:
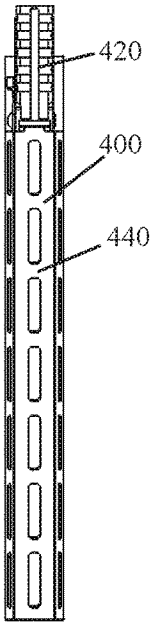
FIG. 33C illustrates a top view of the handguard system shown in FIG. 33A.
Figure 33D:
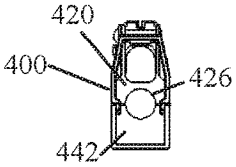
FIG. 33D illustrates a front end view of the handguard system shown in FIG. 33A.

As shown in FIG. 33A, in some implementations, the flange 456 extending from the top sidewall 454 of the upper handguard section 452 may be configured to interface with the gas tube locking lever 123*a*. In this way, the camming surface of the locking bar extending from the lever of the gas tube locking lever 123*a* may be used to secure the upper handguard section 452 in position. In some implementations, the flange 456 may be configured to fit within a gap located between the two sidewalls of the rear sight block 420 through which the gas tube locking lever bore 123 extends.

As show in FIGS. 33A and 36A, in some implementations, the arms 458 of the upper handguard section 452 extend downwardly from opposing sidewalls thereof, each arm 458 defines a projection slot 458*a* configured to receive a portion of a mating projection 447 therein. In this way, the forward end of the upper handguard section 452 may be secured to the lower handguard section 442. In some implementations, the arms 458 may be any shape suitable for engaging with the mating projections 447 of the lower handguard section 442.

Regarding installation of the handguard system 400. Once a press-fit rear sight block has been removed from the barrel 110 of a firearm, the clamp 426 feature allows the handguard system 400 to be affixed to the barrel 110 without removing other components (e.g., the front sight tower 112) secured thereon. In this way, the handguard system 400 is more easily retrofitted onto existing AK-type rifles 105. A rear sight block that has been press-fit onto the barrel 110 of an AK-type rifle 105 may be removed using a rotary tool (e.g., a Dremel) equipped with a cutting wheel, or by any other suitable tool(s) known to one of ordinary skill in the art.

FIGS. 37-44B illustrate an AK-type firearm 105 equipped with yet another example handguard system 500 manufactured in accordance with the principles of the present disclosure. In some implementations, the handguard system 500 is similar to the handguard systems 100, 200, 300, 400 discussed above, in particular the handguard system 400 shown in FIGS. 33A-33D, but the rear sight block 520 and the upper handguard section 552 are a single unitary piece, and the handguard system 500 may further comprise a gas tube yoke 590.

As shown in FIGS. 40A-40D and 44A-44B, the handguard system 500 may comprise a rear sight block 520 and an upper handguard section 552 that are a single unitary piece, a lower handguard section 542, and a gas tube yoke 590.

Figure 40A:
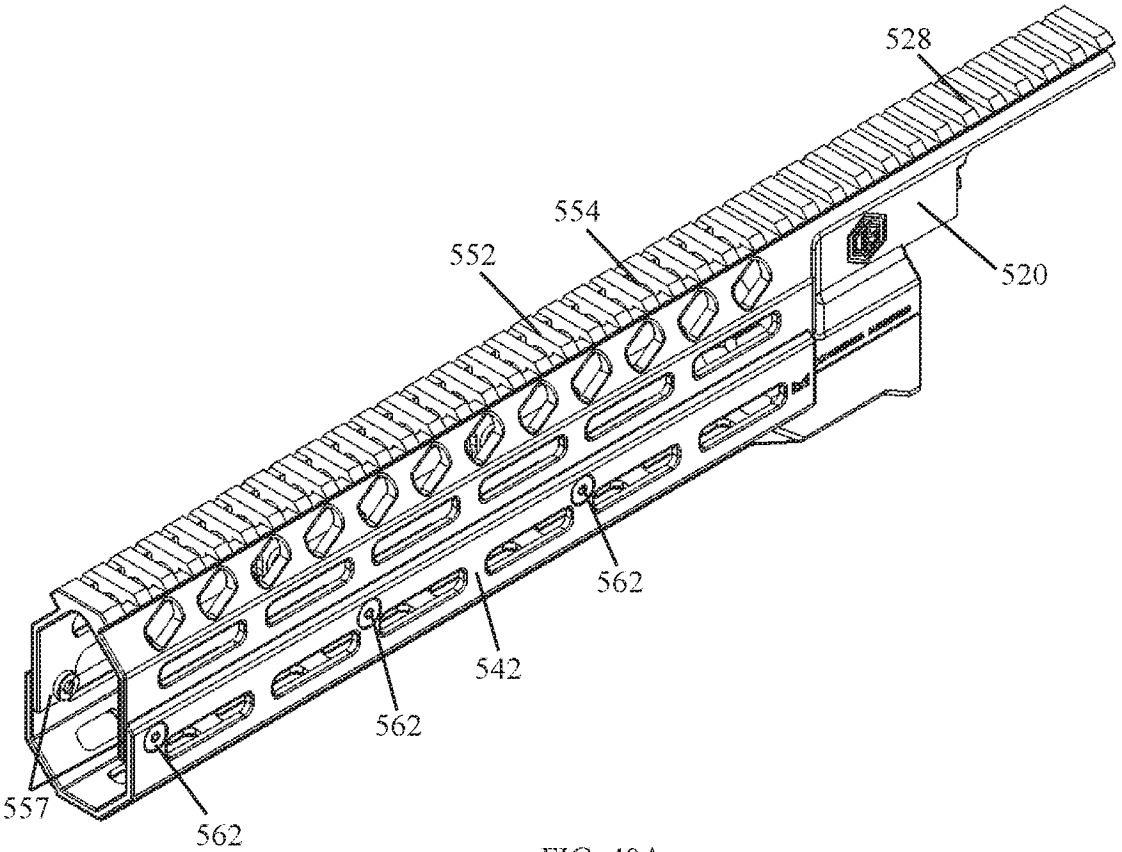
FIG. 40A illustrates a side perspective view of the handguard system shown in FIG. 37, wherein the handguard system is not mounted on an AK-type rifle.
Figure 40C:
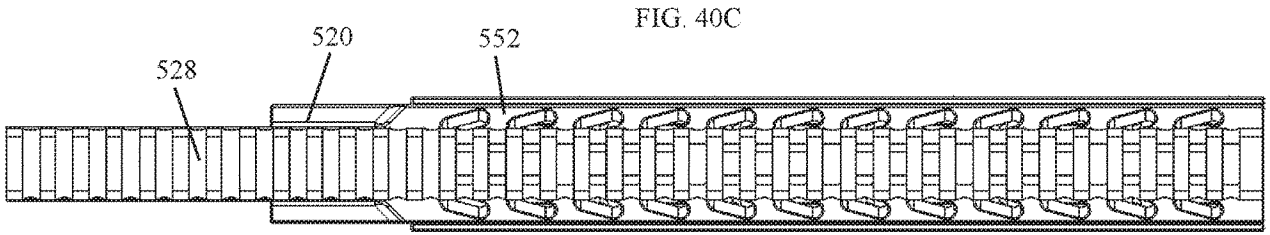
FIG. 40C illustrates a top view of the handguard system shown in FIG. 40A.
Figure 40B:
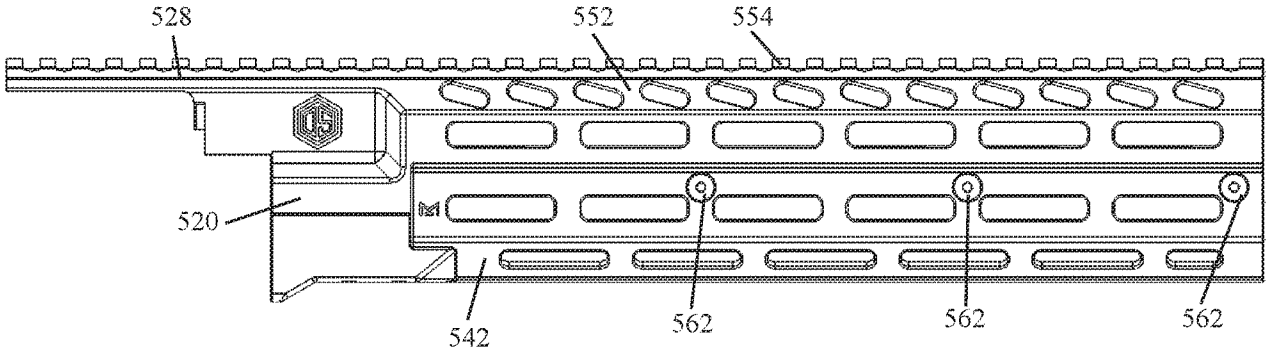
FIG. 40B illustrates a right side view of the handguard system shown in FIG. 40A.
Figure 40D:
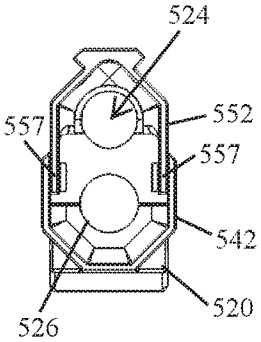
FIG. 40D illustrates a front end view of the handguard system shown in FIG. 40A.

In some implementations, a portion of the rear sight block 520 and the lower handguard section 542, together, form a clamp 526 that is configured to affix the handguard system 500 to the barrel 110 of an AK-type rifle 105 (see, e.g., FIG. 40D). In some implementations, the clamp 526 formed by the rear sight block 520 and the lower handguard section 542 is configured to serve the same function as the sleeve found on prior art rear sight blocks used with AK-type rifles. In this way, the handguard system 500 may be precisely positioned and rigidly secured to the barrel 110 of an AK-type rifle 105.

Figure 41B:
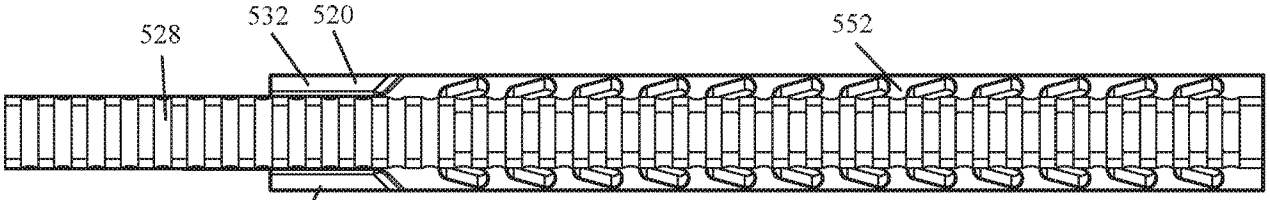
FIG. 41B illustrates a top view of the rear sight block with the integrated upper handguard section shown in FIG. 41A.
Figure 41A:
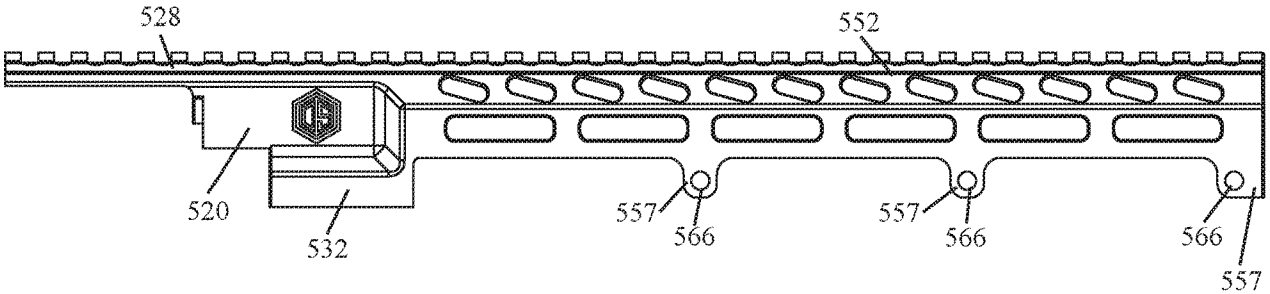
FIG. 41A illustrates a right side view of the rear sight block with the integrated upper handguard section shown in FIG. 40A.
Figure 41C:
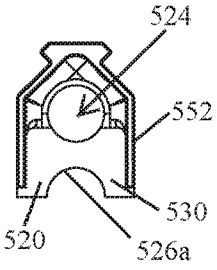
FIG. 41C illustrates a rear end view of the rear sight block with the integrated upper handguard section shown in FIG. 41A.
Figure 42C:
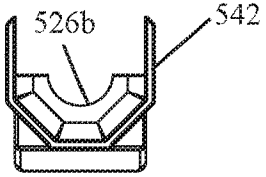
FIG. 42C illustrates a front end view of the lower handguard section shown in FIG. 42A.
Figure 42B:
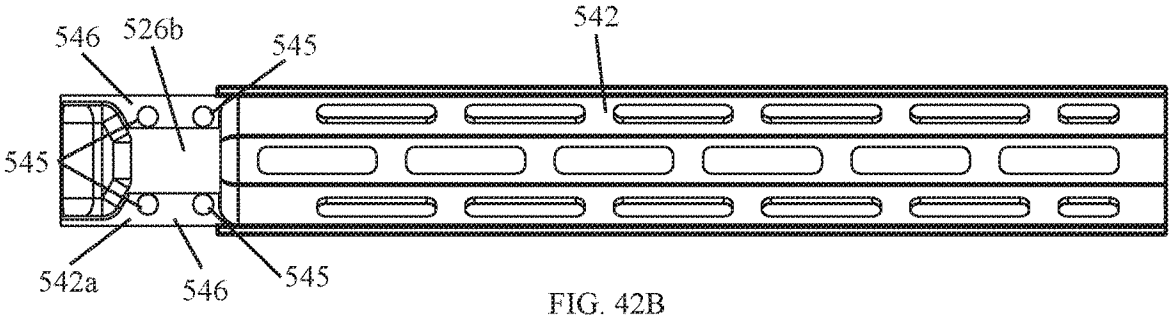
FIG. 42B illustrates a top view of the lower handguard section shown in FIG. 42A.
Figure 42A:
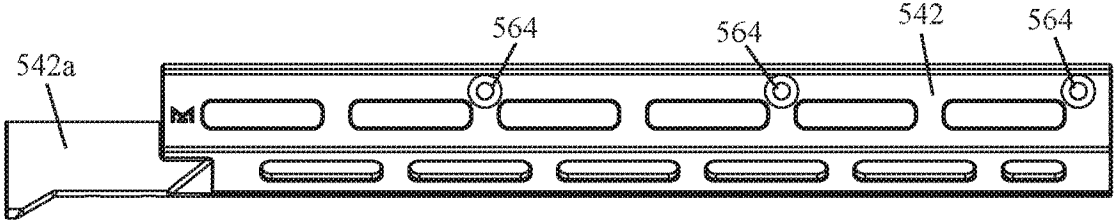
FIG. 42A illustrates a right side view of the lower handguard section shown in FIG. 40A.

As shown in FIGS. 41C, 42B, and 42C, in some implementations, the bottom side 530 of the rear sight block 520 and the first end portion 542*a* of the lower handguard section 542 include clamp jaws 526*a*, 526*b* configured to cooperatively engage with the outer surface of the firearm barrel 110. In some implementations, each clamp jaw 526*a*, 526*b* may be a semi-circular surface that corresponds to the diameter of the firearm barrel 110. In some implementations, fasteners (e.g., screws) extend through aligned openings (e.g., openings 545), in the flanges 532 of the rear sight block 520 and the opposing sidewalls 546 of the lower handguard section 542, to draw the clamp jaws 526*a*, 526*b* together (see, e.g., FIG. 40D). In this way, the rear sight block 520 and the lower handguard section 542 may be affixed (i.e., clamped) to the barrel 110 of an AK-type rifle 105 (see, e.g., FIG. 38).

As shown in FIGS. 40A and 40B, in some implementations, the lower handguard section 542 and the upper handguard section 552 may be secured directly together by fasteners 562 (e.g., screws) that extend through openings 564, 566 (see FIGS. 41A and 42A) which align when the rear sight block 520 and the lower handguard section 542 have been clamped onto the barrel 110 of the rifle. In some implementations, mating projections 557 extend downwardly from opposing sidewalls of the upper handguard section 552, the mating projections 557 may be configured to fit between the opposing sidewalls of the lower handguard section 542 (see, e.g., FIGS. 40A and 40D). In this way, the opening 566 extending through each mating projection 447 of the upper handguard section 552 may be placed into alignment with a corresponding opening 564 in a sidewall of the lower handguard section 542.

Figure 43B:
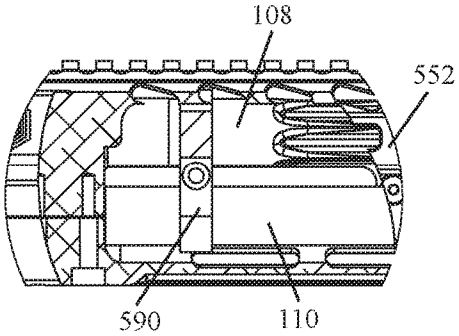
FIG. 43B illustrates a portion of FIG. 43A that has been enlarged for magnification purposes.
Figure 43A:
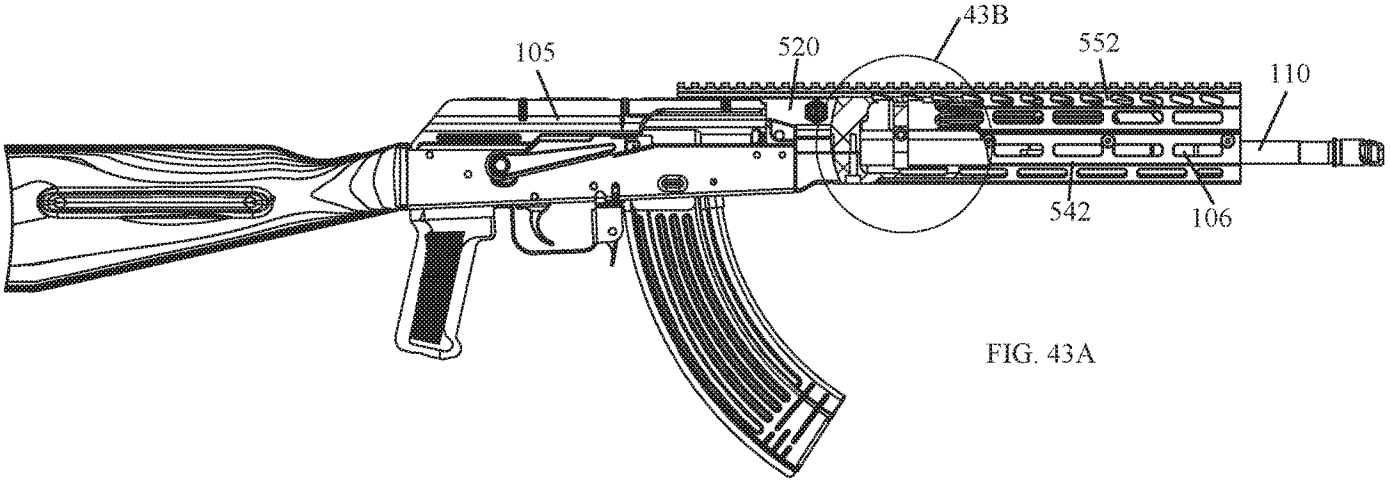
FIG. 43A illustrates a partial sectional view of the handguard system shown in FIG. 37, wherein the gas tube yoke is shown secured about a portion of a gas tube and a firearm barrel.

As shown in FIG. 43B, in some implementations, without making contact with the rear sight block 520, the gas tube yoke 590 may be configured to position the gas tube 108 between the gas block 106 secured to the barrel 110 and the guide bore 524 of the rear sight block 520. In this way, the portion of the barrel 110 extending from the receiver of the AK-type rifle 105 may be isolated from the rear sight block 520 of the handguard system 500, thereby free floating the barrel 110. Further, the gas tube yoke 590 is configured to position the gas tube 108 so that it is held in coaxial alignment with the guide bore 524 of the rear sight block 520. In this way, the piston 107 of an AK-type rifle 105 may pass therethrough (see, e.g., FIG. 39B).

Figure 44A:
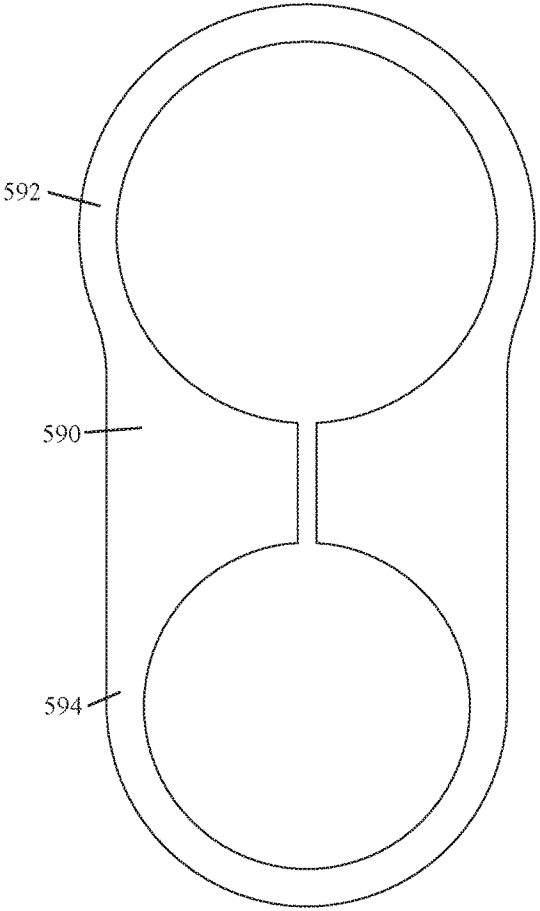
FIG. 44A illustrates a gas tube yoke manufactured in accordance with the principles of the present disclosure.
Figure 44B:
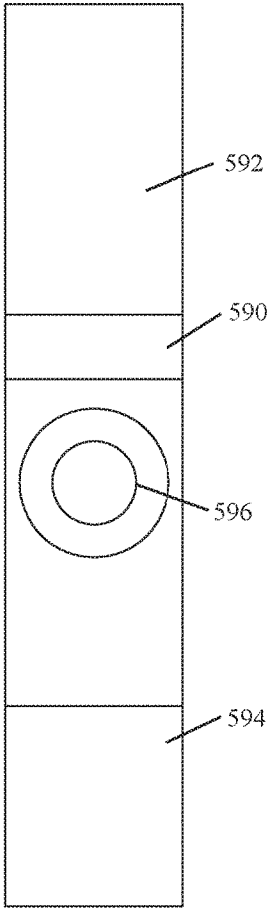
FIG. 44B illustrates a side view of the gas tube yoke shown in FIG. 44A.

As shown in FIGS. 44A and 44B, in some implementations, the gas tube yoke 590 may comprise a first clamp 592 positioned adjacent a second clamp 594, and a fastener (e.g., a threaded fastener). In some implementations, the first clamp 592 and the second clamp 594 may be configured to fit about a portion of the gas tube 108 and the barrel 110, respectively (see, e.g., FIG. 43B). In some implementations, the gas tube yoke 590 may be configured so that tightening the fastener positioned within the opening 596 causes the clamp jaws of each clamp 592, 594 to be drawn together. In this way, the first clamp 592 and the second clamp 594 may be affixed to the gas tube 108 and the barrel 110, respectively.

In some implementations, the gas tube yoke 590 may be another structure configured to support a first end of the gas tube 108 and hold it in coaxial alignment with the guide bore 524 of rear sight block 520. For example, in some implementations, the gas tube yoke 590 could be a saddle structure secured to the underside of the gas tube 108 that is configured (e.g., contoured) to rest on the barrel 110 (not shown).

As shown in FIGS. 40A and 40B, in some implementations, the handguard system 500 may further comprise an integral top firearm accessory mounting rail 554 that extends along the top of the rear sight block 520 and the upper handguard section 552.

As shown in FIG. 40B, in some implementations, the optic mounting interface 528 of the rear sight block 520, a portion of the integral top accessory mounting rail 554, may extend past the backend thereof. In this way, for example, an optical gun sight may be positioned closer to the shooter's eye.

In some implementations, the handguard system 500 may further comprise a heat shield (e.g., the heat shield 370 shown in FIGS. 29A-29C) that is positioned within the interior of the lower handguard section 542, a front cap (e.g., the front cap 380 shown in FIGS. 28A-28C) that is secured to the distal end of the handguard, or a combination thereof.

Regarding installation of the handguard system 500. Initially, in some implementations, the press-fit rear sight block and/or the front sight tower may be removed from the barrel 110 of a firearm. Then, in some implementations, the gas tube yoke 590, the gas tube 106, and the gas block 106 may be positioned on and secured to the barrel 110. Next, the clamp feature 526 of the handguard system 500 may be used to secure the rear sight block 520, with the integrated upper handguard section 552, and the lower handguard section 542 to the barrel 110. In this way, the handguard system 500 is easily retrofitted onto existing AK-type rifles 105 (see, e.g., FIG. 43A).

In some implementations, the rear sight block 120, 220, 320, 420 may be fabricated from a steel alloy. In some implementations, the rear sight block 120, 220, 320, 420 may be fabricated from any suitable material (e.g., an aluminum alloy) known to one of ordinary skill in the art. In some implementations, the rear sight block 120, 220, 320, 420 may be fabricated using one or more of the following processes: machining, forging, extruding, casting, and sintering.

In some implementations, the handguard 140, 340, 440 may be fabricated from an aluminum alloy. In some implementations, the handguard 140, 340, 440 may be fabricated from any suitable material (e.g., a steel alloy) known to one of ordinary skill in the art. In some implementations, the handguard 140, 340, 440 may be fabricated using one or more of the following processes: machining, forging, extruding, casting, and sintering.

In some implementations, the handguard chassis 242 and/or the heat shield 243 of a handguard 240 may be fabricated from an aluminum alloy. In some implementations, the handguard chassis 242 and/or the heat shield 243 may be fabricated from any suitable material (e.g., a steel alloy) known to one of ordinary skill in the art. In some implementations, the handguard chassis 242 and/or the heat shield 243 may be fabricated using one or more of the following processes: machining, forging, extruding, casting, and sintering.

In some implementations, the protective outer cover 252 of the handguard 240 may be fabricated from a polymer material. In some implementations, the protective outer cover 252 may be fabricated from any suitable material known to one of ordinary skill in the art. In some implementations, the protective outer cover 252 may be fabricated using one or more of the following processes: machining, injection molding, and/or 3-D printing.

In some implementations, the heat shield 370 of the handguard system 300 may be fabricated from an aluminum alloy. In some implementations, the heat shield 370 may be fabricated from any suitable material (e.g., a steel alloy and/or a polymer) known to one of ordinary skill in the art. In some implementations, the heat shield 370 may be fabricated using one or more of the following processes: machining, forging, extruding, casting, and/or stamping.

In some implementations, the rear sight block 520 with the integrated upper handguard section 552, the lower handguard section 542, and/or the gas tube yoke 590 may be fabricated from an aluminum alloy. In some implementations, the rear sight block 520 with the integrated upper handguard section 552, the lower handguard section 542, and/or the gas tube yoke 590 may be fabricated from any suitable material (e.g., a steel alloy) known to one of ordinary skill in the art. In some implementations, the rear sight block 520 with the integrated upper handguard section 552, the lower handguard section 542, and/or the gas tube yoke 590 may be fabricated using one or more of the following processes: machining, forging, extruding, casting, and sintering.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A free-floating handguard system for a rifle comprising:

a rear sight block including a lower portion that has a bore extending therethrough, the bore is configured to fit about a barrel of a rifle; and a handguard including a first end portion and an opposed second end portion, the first end portion of the handguard can be removably secured to the lower portion of the rear sight block;

wherein a front end of the rear sight block receives a first end of a gas tube and holds the gas tube in place on the rifle.

2. The handguard system of claim 1, wherein the lower portion of the rear sight block also includes a first sidewall that has a first guide groove therein and a second sidewall that has a second guide groove therein; and wherein the first end portion of the handguard includes a first boss that is configured to be received within the first guide groove of the rear sight block and a second boss that is configured to be received within the second guide groove of the rear sight block.

3. The handguard system of claim 2, wherein the handguard is a single unitary piece.

4. The handguard system of claim 2, wherein the handguard comprises a lower handguard section that can be secured to the lower portion of the rear sight block and an upper handguard section that can be secured to the lower handguard section.

5. The handguard system of claim 4, wherein the first end portion of the lower handguard section clamps onto the lower portion of the rear sight block when secured thereto by fasteners.

6. The handguard system of claim 4, further comprises a heat shield that is positioned within the lower handguard section to reflect heat emanating from the barrel, the heat shield is offset from the lower handguard section by one or more spacers.

7. The handguard system of claim 2, further comprises a front cap that is secured to the second end portion of the handguard, the front cap is configured to minimize deflection of the handguard.

8. The handguard system of claim 1, wherein the lower portion of the rear sight block also includes a first sidewall that has a first boss thereon and a second sidewall that has a second boss thereon; and wherein the first end portion of the handguard includes a first guide groove therein that is configured to receive the first boss of the rear sight block therein and a second guide groove that is configured to receive the second boss of the rear sight block therein.

9. The handguard system of claim 8, wherein the handguard comprises a handguard chassis that can be secured to the lower portion of the rear sight block, a heat shield positioned within the handguard chassis that is configured to act as a thermal break, and a protective outer cover for the handguard chassis.

10. The handguard system of claim 9, wherein the first end portion of the handguard chassis clamps onto the lower portion of the rear sight block when secured thereto by fasteners.

11. The handguard system of claim 9, wherein the handguard chassis further comprises a first longitudinally extending channel on a first side thereof and a second longitudinally extending channel on a second side thereof, the first and second longitudinally extending channels are configured to facilitate the attachment of the protective outer cover to the handguard chassis.

12. A free-floating handguard system for a rifle comprising:

a rear sight block including a clamp jaw on a bottom side thereof;

a handguard including a lower handguard section and an upper handguard section;

wherein a front end of the rear sight block receives a first end of a gas tube and holds the gas tube in place on the rifle;

wherein the lower handguard section includes a first end portion having a clamp jaw thereon and an opposed second end portion; and wherein the clamp jaws of the rear sight block and the lower handguard section are configured to cooperatively engage with the outer surface of a rifle barrel.

13. The handguard system of claim 12, wherein each clamp jaw is a semi-circular surface that is configured to interface with a portion of the rifle barrel.

14. The handguard system of claim 12, wherein the upper handguard section also includes a flange that extends from a first end thereof, the flange is configured to interface with a gas tube locking lever on the rear sight block.

15. The handguard system of claim 12, wherein the handguard is a single unitary piece.

16. The handguard system of claim 12, wherein the rear sight block and the upper handguard section are a single unitary piece.

17. The handguard system of claim 16, further comprising an integral top firearm accessory mounting rail extending along a top of the rear sight block and the upper handguard section.

18. The handguard system of claim 12, further comprising a gas tube yoke that is configured to position a gas tube of a rifle between a barrel mounted gas block and the rear sight block.

19. The handguard system of claim 18, wherein the gas tube yoke comprises a first clamp positioned adjacent a second clamp, and a fastener, the gas tube yoke is configured so that tightening the fastener causes clamp jaws of the first clamp and the second clamp to be drawn together.

20. The handguard system of claim 12, further comprises a heat shield that is positioned within the lower handguard section to reflect heat emanating from the rifle barrel, the heat shield is offset from the lower handguard section by one or more spacers.

* * * * *